United States Patent [19]

Gray

[11] 4,435,198

[45] Mar. 6, 1984

[54] SEPARATION OF NITROGEN FROM NATURAL GAS

[75] Inventor: Michael L. Gray, Bartlesville, Okla.

[73] Assignee: Phillips Petroleum Company, Bartlesville, Okla.

[21] Appl. No.: 351,727

[22] Filed: Feb. 24, 1982

[51] Int. Cl.[3] ..... F25J 3/02

[52] U.S. Cl. ..... 62/28; 62/31; 62/34

[58] Field of Search ..... 62/9, 11, 23, 24, 31, 62/34, 38, 39, 42

[56] References Cited

U.S. PATENT DOCUMENTS 2,557,171 6/1951 Bodle et al. ..... 62/39

*Primary Examiner*—Frank Sever

[57] ABSTRACT

A process and apparatus for reducing the nitrogen content of a liquefied, normally gaseous feed comprising predominantly methane with a significant amount of nitrogen and having an elevated pressure in which the feed is separated into a first vapor phase portion, containing a major portion of nitrogen, and an unvaporized first liquid phase portion, the first vapor phase portion is cooled, the cooled first vapor phase portion is further separated into a second vapor phase portion, further enriched in nitrogen, and an unvaporized second liquid phase portion, the unvaporized first and second liquid phase portions are combined, an expanded body of fluids is formed from the combined unvaporized first and second liquid phase portions, at least part of the cooling of the first vapor phase portion is carried out by passing the same in indirect heat exchange with the expanded body of fluids formed from the unvaporized first and second liquid phase portions and the expanded body of fluids formed from the unvaporized first and second liquid phase portions is separated into a third vapor phase portion and an unvaporized third liquid phase portion.

17 Claims, 15 Drawing Figures

SEPARATION OF NITROGEN FROM NATURAL GAS

BACKGROUND OF THE INVENTION

The present invention relates to a process for separating nitrogen from a liquefied gas predominating in methane and containing a significant amount of nitrogen. More specifically, the present invention relates to the separation of nitrogen from a liquefied gas predominating in methane and containing a significant amount of nitrogen in conjunction with the liquefaction thereof.

While most natural gas predominates in methane, it can also contain significant amounts of $C_2$, $C_3$, $C_4$ and $C_5$ and higher molecular weight hydrocarbons. Where the gas is to be used as a fuel the $C_2$ and higher molecular weight hydrocarbons are generally removed, to the extent practical, since these materials are generally of greater value for purposes other than as a gaseous heating fuel. For example, $C_2$, $C_3$ and $C_4$ are valuable chemical intermediaries and the $C_3$ and $C_4$ hydrocarbons are of greater value when separated and utilized as liquefied petroleum gases (LPG). $C_5$ and higher molecular weight hydrocarbons increase the heating value of natural gas but are normally removed, since they are valuable as blending stocks for motor fuels and for other purposes. In addition, failure to remove $C_5$ and heavier hydrocarbons at an early stage can cause freezing problems in later stages of the process. However, in addition to these useful components, natural gas will in most cases also contain significant amounts of acid gases such as $CO_2$ and $H_2S$, water and nitrogen, all of which are considered impurities which reduce the heating value of the natural gas, cause other problems and are removed in most instances to the extent possible.

There are a number of valid reasons for the liquefaction of natural gas. For example, demand for the gas is seasonal and thus during certain periods demand is higher than normal, while during other periods demand is lower than normal. In order to be able to supply gas during periods of peak demand, it is customary to store gas at the area of use during periods of low demand for use during the periods of high demand. The most practical and economical method of storing natural gas in most instances is by the liquefaction of natural gas, since liquefaction reduces the volume of the gas to about 1/600 of the volume of the natural gas in its gaseous state. A highly significant increase in the liquefication of natural gas is for transport, particularly by ocean-going vessels, where the transport of natural gas in its gaseous state by pipeline is either impractical or impossible. In order to store or transport natural gas in its liquefied state, the temperature of the gas is reduced to about −258° F. at atmospheric pressure.

In the liquefaction of natural gas it is customary to first remove acid gases such as $CO_2$ and $H_2S$ and then pass the gas through a dehydration system to remove water. The gas is then cooled by passing the same sequentially through a plurality of cooling stages, at successively lower temperatures, in which cooling is carried out by the expansion of compressed refrigerants in heat exchange with the gas to be liquefied. The refrigerants are derived either from the natural gas itself or supplied from an external source. One common practice is to utilize a series of successively lower boiling point refrigerants, such as propane or propylene followed by ethane or ethylene and finally methane. The refrigerants thus utilized are supplied in liquefied form by compression-refrigeration systems usually arranged in cascade fashion when a plurality of refrigerants are utilized in sequence. However, a more efficient process compresses the gas to a high pressure, if it is not already at a sufficiently high pressure, prior to cooling and substitutes a series of pressure reduction or flash stages for the methane cycle. This not only has the advantage of further cooling the gas as it is being reduced in pressure to essentially atmospheric pressure but the refrigeration potential of the flashed gases which result from the pressure reduction steps can be utilized to further cool the liquefied gas and then be recycled back to the main gas stream. For purposes of such recycle the gas is generally compressed to a pressure near the pressure of the main gas stream at the point at which the recycle gas is recombined therewith and in some instances cooled to a temperature near the temperature of the main gas stream at such point of recombination. In the last mentioned natural gas liquefaction systems it is conventional practice to remove the nitrogen after the natural gas has been liquefied by either passing the gas through a fractionation column, usually referred to as a nitrogen removal column, or in the first stage of the multiple stage pressure reduction cycle. In both instances the vapor phase containing the major portion of the nitrogen is still primarily methane and therefore is utilized as a fuel for use in operating compressors, turbines and the like in the liquefaction plant. In any event, such conventional nitrogen separation systems do not remove a sufficient volume of the nitrogen, particularly where the gas has a higher nitrogen content, and are inefficient energywise. For example, in addition to reducing the heating value of the liquefied natural gas, the retention of too much nitrogen in the liquefied natural gas will result in increasing the horsepower requirements for compressing the recycle gas and to some extent the horsepower requirements for compressing the refrigerants utilized to liquefy the gas. Such conventional nitrogen separation systems also fail to utilize the full refrigeration potential of the flashed gases in some instances.

SUMMARY OF THE INVENTION

It is therefore an object of the present invention to overcome the above-mentioned and other disadvantages of the prior art processes. Another object of the present invention is to provide an improved process for the separation of nitrogen from a liquefied gas predominating in methane and containing significant amounts of nitrogen. A further object of the present invention is to provide an improved process for the separation of nitrogen from a liquefied natural gas stream containing significant amounts of nitrogen. Another and further object of the present invention is to provide an improved system for the separation of nitrogen from a liquefied natural gas, containing significant amounts of nitrogen, in conjunction with the liquefaction of the gas, wherein the overall energy requirements of the plant are significantly reduced. Yet another object of the present invention is to provide an improved process for the separation of nitrogen from a liquefied natural gas, containing significant amounts of nitrogen, in which the horsepower requirements for the compression of gases throughout the liquefaction plant are significantly reduced. Still another object of the present invention is to provide an improved process for the separation of nitrogen from a liquefied gas, containing significant amounts of nitrogen, in conjunction with the liquefaction of the gas by cryogenic cooling. A still further object of the present invention is to provide an improved process for the separation of nitrogen from a liquefied natural gas, containing significant amounts of nitrogen, in conjunction with a liquefaction process, involving refrigeration of a high pressure gas, multistage pressure reduction and recycle of the gas flashed during pressure reduction, wherein the energy required to compress the flashed gases for recycle is substantially reduced. Still another object of the present invention is to provide an improved process for the separation of nitrogen from a liquefied natural gas, in which the nitrogen is removed and utilized as a fuel gas within the plant, wherein the refrigeration potential of the thus separated fuel gas is utilized more effectively. Another and further object of the present invention is to provide an improved process for the separation of nitrogen from a high pressure, liquefied gas, containing significant amounts of nitrogen, in conjunction with liquefaction of the gas by refrigeration and multistage expansion, in which the nitrogen is removed as a vapor phase fuel gas and the energy potential of the thus removed fuel gas is utilized more effectively. These and other objects of the present invention will be apparent from the following description.

In accordance with the present invention the nitrogen content of a high pressure, liquefied gas, comprising predominantly methane with a significant amount of nitrogen, is reduced by separating the liquefied gas into a first vapor phase portion containing a major portion of the nitrogen and an unvaporized first liquid phase portion, cooling the thus separated first vapor phase portion, separating the thus cooled first vapor phase portion into a second vapor phase portion further enriched in nitrogen and an unvaporized second liquid phase portion, combining the unvaporized first and second liquid phase portions, forming an expanded body of fluids from the thus combined unvaporized first and second liquid phase portions, providing at least a part of the cooling of the separated first vapor phase portion by passing the separated first vapor phase portion in indirect heat exchange through the expanded body of the combined first and second liquid phase portions and separating the expanded body of the combined unvaporized first and second liquid phase portions into a third vapor phase portion and an unvaporized third liquid phase portion. The second vapor phase portion further enriched in nitrogen and the combined unvaporized first and second liquid phase portions may also be expanded and passed in indirect heat exchange with the first vapor phase portion enriched in nitrogen to provide at least a part of the cooling of the separated first vapor phase portion enriched in nitrogen.

DESCRIPTION OF THE PREFERRED EMBODIMENTS

Figure 1A:
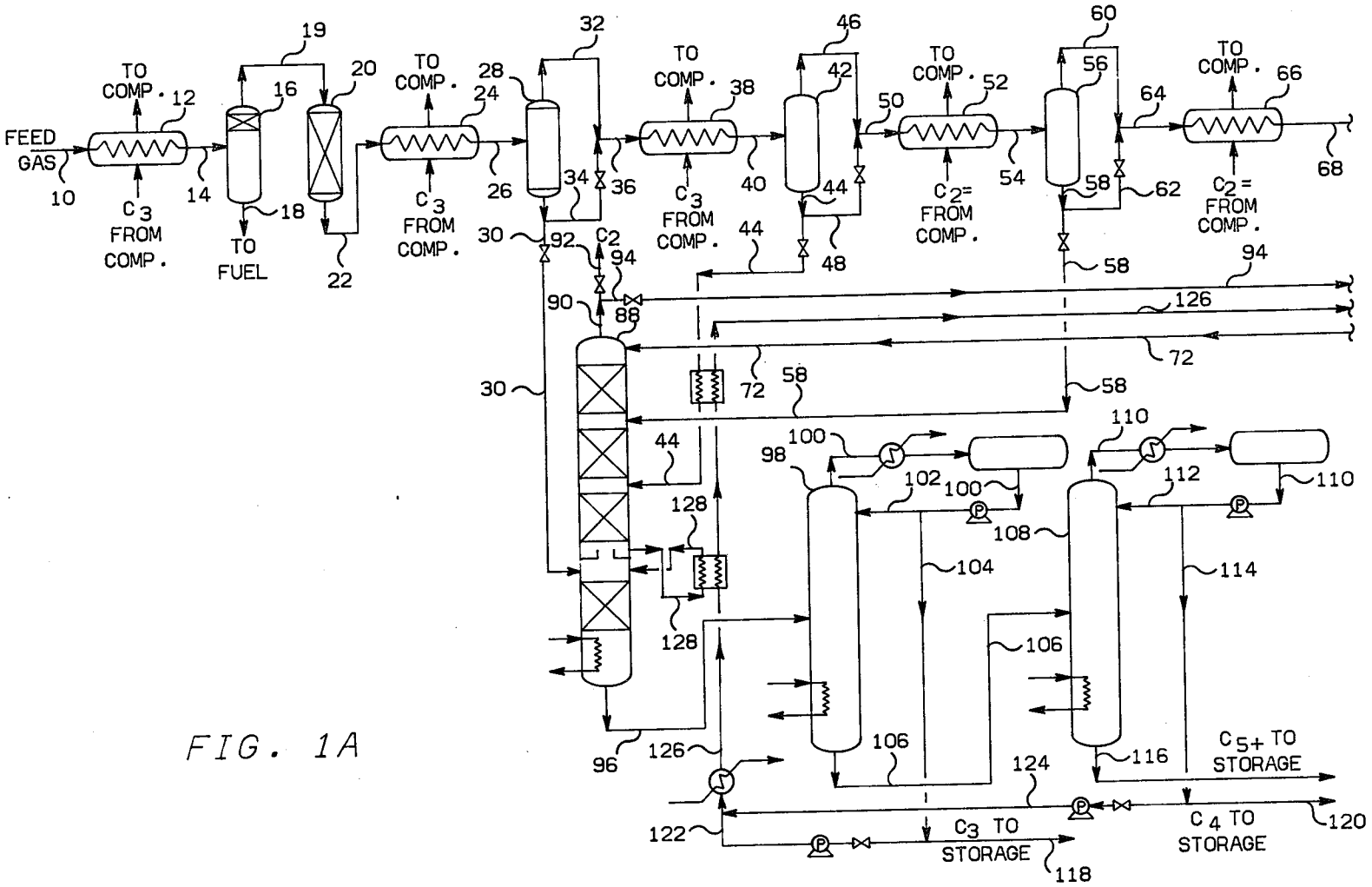
FIG. 1A, B, is a simplified flow diagram of a natural gas liquefaction system including one embodiment of the present invention.

The nature of the present invention and the advantages thereof will be apparent from the following detailed description when read in conjunction with the drawings. In the drawings it is to be understood that numerous conventional valves, control systems and the like have not been included since the use of such equipment would be obvious to one skilled in the art and their inclusion would unduly complicate the drawings and description.

While the present invention may be utilized in a separation of nitrogen from any high pressure, liquefied gas containing nitrogen, the invention is particularly useful in the separation of nitrogen from a high pressure, liquefied natural gas. Still more specifically, the present invention is useful in conjunction with a system for the liquefaction of a high pressure natural gas comprising predominately methane and containing a significant amount of nitrogen. Accordingly, in describing the invention with reference to the drawings, reference will be made to the liquefaction of natural gases and the use of the invention therein.

While the present invention may also be utilized in the separation of nitrogen from any natural gas, FIG. 1 of the drawings will be described with reference to the liquefaction of high pressure, natural gas feeds, having a pressure of about 595 psia and a temperature of about 110° F., and, for example, having the following approximate compositions:

TABLE I

| | Mol % | |
|---|---|---|
| Component | Feed A | Feed B |
| $N_2$ | 0.76 | 1.81 |
| $C_1$ | 86.80 | 98.05 |
| $C_2$ | 7.85 | .12 |
| $C_3$ | 3.97 | .02 |
| $C_4$ | .56 | — |
| $C_5$+ | .06 | — |

Figure 1B:
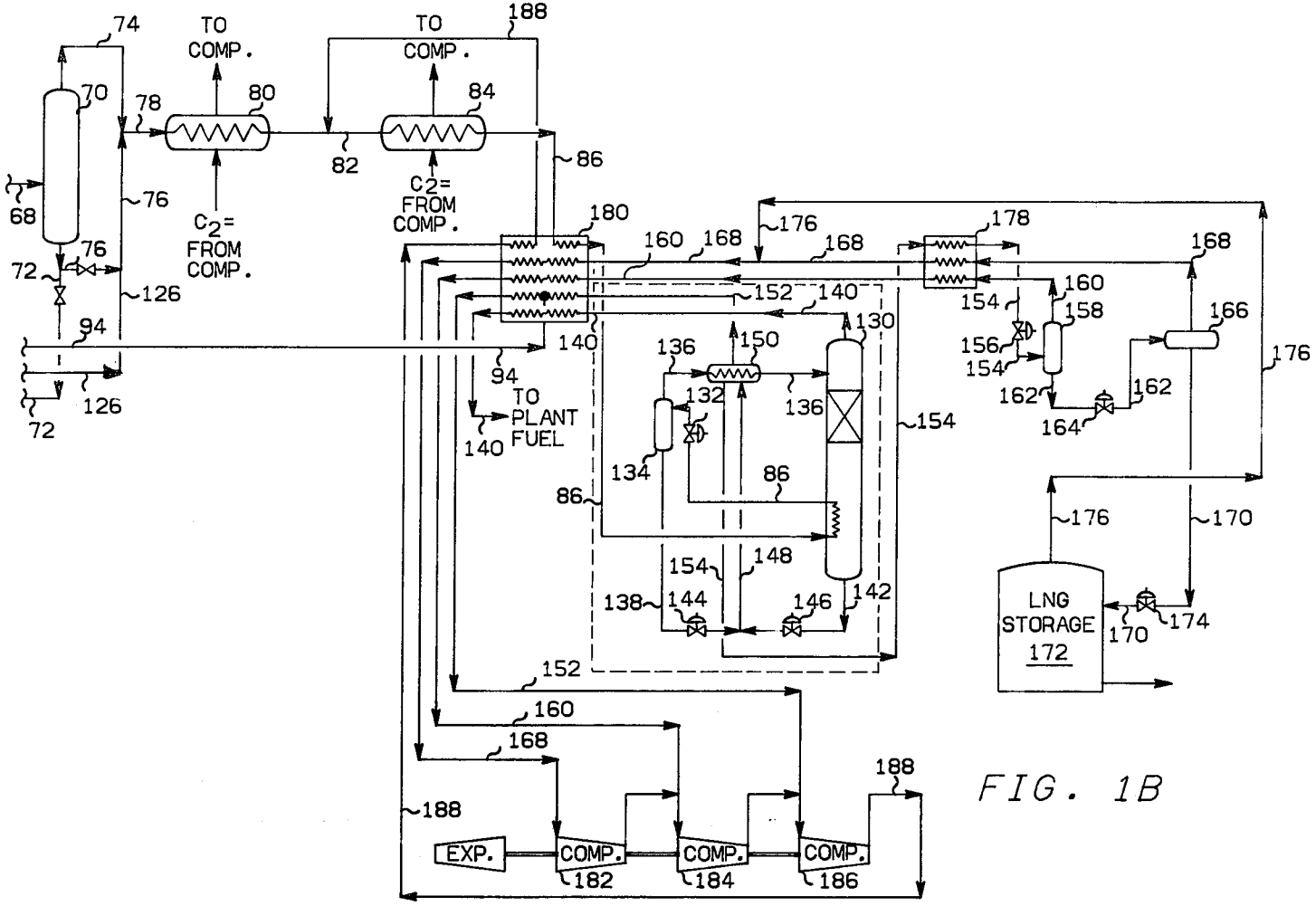

With reference to FIG. 1 of the drawings it is to be understood that the feed gas has been subjected to conventional treatments to remove acid gases, such as $CO_2$ and $H_2S$. It is also to be understood that the gas has been compressed to or already is at a high pressure between about 300 and 1500 psia and typically between about 500 and 900 psia. In accordance with FIG. 1, the natural gas feed is introduced to the system through line 10. The feed gas then passes in indirect heat exchange with a body of fluids produced by expanding liquefied propane in a high stage propane feed gas chiller 12. The compressed and liquefied propane is supplied from a conventional compression-refrigeration system (not shown). The cooled feed gas then passes through line 14 to vapor-liquid separator 16. In passing through chiller 12 a portion of the highest molecular weight hydrocarbons contained in the feed gas are condensed and are separated from the main gas stream in separator 16. Separator 16 is commonly referred as a dehydrator-liquid knockout pot. A bottoms liquid portion is withdrawn through line 18 and is suitable for use as a fuel. The remaining portion of the main gas stream is passed through line 19 to dehydrator 20. Dehydrator-regeneration equipment normally associated with dehydrator 20 is not shown. The dehydrated main gas stream then passes through line 22 to intermediate stage propane feed gas chiller 24. Feed gas leaving chiller 24 passes through line 26 to a vapor-liquid separator 28 where liquids condensed by chiller 24 are separated and discharged through line 30 while the vapor phase portion of the main gas stream is discharged through line 32. Flexibility is provided to the extent that at least a portion of the separated liquid passing through line 30 may be recombined with the main gas stream through line 34 and the combined stream passed through line 36 to low stage propane feed gas chiller 38. The main gas stream from chiller 38 passes through line 40 to vapor-liquid separator 42, wherein liquids condensed by chiller 38 are withdrawn through line 44 and the remaining vapor state main gas stream is discharged through line 46. Again, flexibility of operation can be provided by passing at least a part of the liquid, withdrawn through line 44, through line 48 where it is combined in line 50 with the main gas stream passing through line 46. The main gas stream passing through line 50 is fed to high stage ethylene feed gas chiller 52. From chiller 52 the main gas stream passes through line 54 to vapor-liquid separator 56. In separator 56, condensed liquids are withdrawn through line 58 and the remaining main gas stream, in a vapor state, is withdrawn through line 60. At least a portion of the liquid withdrawn through line 58 may be recombined through line 62 with the main gas stream. The main gas stream then passes through line 64 to a first intermediate stage ethylene feed gas chiller 66. From chiller 66 the main gas stream passes through line 68 to vapor-liquid separator 70. In vapor-liquid separator 70, condensed liquid is separated and withdrawn through line 72 and the main feed gas stream in a vapor state is discharged through line 74. At least a portion of the separated liquid passing through line 72 may be recombined, through line 76, with the main gas stream. At this point most of the $C_2$ and higher molecular weight hydrocarbons have been removed from the feed gas and the remaining feed gas is composed principally of methane. The main gas stream then passes through line 78 to second intermediate stage ethylene feed gas chiller 80 where it is further cooled and a significant portion thereof liquefied. The cooled main gas stream then passes through line 82 to low stage ethylene feed gas chiller 84, wherein the feed gas comprising principally methane is liquefied and passed through line 86. The further treatment of the liquefied gas passing through line 86 will be described at a later point in the description.

While propane and ethylene have been shown as refrigerants for the liquefaction of the natural gas feed it is to be understood that other appropriate refrigerants may be utilized. For example, propylene may be substituted for propane and ethane could be utilized in place of ethylene. Ethylene is supplied to the ethylene feed gas chillers as a compressed liquid which is expanded into the chillers and the feed gas to be cooled is then passed in indirect heat exchange with the fluids produced by expanding the ethylene. Again, the ethylene compression-refrigeration system is conventional and is not shown in the drawings nor is the cascading of the propane and ethylene systems.

The liquid phase portions separated from the main gas stream in separators 70, 56, 42 and 28 and comprising predominately $C_2$, $C_3$, $C_4$ and $C_5$ and higher molecular weight hydrocarbons, respectively, are then passed to separator 88 for further separation. In this particular case, the preferred separator 88 is a fractionation column equipped with appropriate packing or bubble trays to provide intimate contact of fluids in the column. Column 88 will generally be supplied with sufficient heat to vaporize a portion of the liquid phase streams, as by a steam heater or other appropriate means in the bottom of the column. The first separated liquid phase portion passing through line 30 is preferably introduced at a lowermost point in the column while the second, third and fourth liquid phase portions passing through lines 44, 58 and 72 will be introduced at successively higher points in the system. Thus, the uppermost introduced fluids act as a reflux for the fluids introduced at lower points while the vapors from the fluids introduced at lower points act as a stripping means for the fluids introduced at points thereabove. Column 88 is operated in a manner such that a vapor phase predominating in $C_2$ hydrocarbons but also containing some methane will be vaporized and discharged from the column through line 90. If desired, at least a portion of the $C_2$ and lower boiling components may be withdrawn through line 92 since, depending upon the $C_2$ content of the feed gas and the needs of the operator, the $C_2$ hydrocarbons may be utilized as a chemical feedstock. In a preferred embodiment, however, all of the $C_2$ and lower boiling components are withdrawn through line 94 and are recombined with the main gas stream as hereinafter described. As described, column 88 is operated as what is known as a deethanizer column. The remaining liquid phase separated in column 88 and comprising predominately $C_3$, $C_4$ and $C_5$ and higher molecular weight hydrocarbons is withdrawn through line 96 and fed to column 98 for further separation. Column 98 is preferably a bottom heated column as shown in the drawings. In column 98, normally referred to as a depropanizer, $C_3$ hydrocarbons are vaporized to produce a vapor phase portion predominating in $C_3$ hydrocarbons which is discharged through line 100. As shown in the drawings the vapor phase portion predominating in $C_3$ hydrocarbons may be cooled to condense the same and a portion introduced into column 98 as a reflux through line 102. However, the major portion of the liquefied stream predominating in $C_3$ hydrocarbons is passed through line 104 for further processing or recovery as hereinafter described. The liquid phase portion separated in column 98 and predominating in $C_4$ and $C_5$ and higher molecular weight hydrocarbons is discharged through line 106 and passed to column 108. Column 108 is similar to column 98 and is preferably a heated column as shown.

Column 108 is operated in a manner such that a vapor phase portion predominating in $C_4$ hydrocarbons is produced and discharged through line 110. This vapor phase product is then cooled and condensed and a portion may be introduced into column 108 as a reflux through line 112. The main condensed or liquefied $C_4$ hydrocarbon stream is then discharged through line 114. The liquid phase portion separated in column 108 is discharged through line 116 to storage. Since this liquid phase portion predominates in $C_5$ and higher molecular weight hydrocarbons it may be utilized as a blending stock for gasoline or other appropriate uses.

Since $C_3$ and $C_4$ hydrocarbons are valuable as chemical feedstocks or as liquefied petroleum gases (LPG) they may be recovered from the system through lines 118 and 120, respectively, for further use. Since the remaining portions of the $C_3$ and $C_4$ streams are in the liquid state they can then be conveniently pumped through lines 122 and 124, respectively. The $C_3$ and $C_4$ streams are then combined and passed through line 126. The remaining $C_3$ and $C_4$ streams passing through line 126 may be cooled in at least one stage and recombined with the main gas stream as shown. By thus recycling and recombining the $C_3$ and $C_4$ streams with the main gas stream in a liquid state, this combined stream can be added directly to the main gas stream rather than added to the hereinafter mentioned methane vapors which are recycled to the gas stream. The recombination of the combined $C_3$-$C_4$ stream with the main gas stream is most conveniently carried out after the last separation of a liquid phase portion from the main gas stream, specifically after vapor-liquid separator 70, as shown. Preferably the cooling of the combined $C_3$ and $C_4$ stream, which is recycled to the main gas stream, is carried out by passing the combined $C_3$ and $C_4$ stream in indirect heat exchange with at least a portion of the liquid phase portions separated from the main gas stream in separators 28, 42, 56 and 70. More specifically, the combined $C_3$ and $C_4$ stream is passed in indirect heat exchange with a liquid stream withdrawn from column 88 and reintroduced into the column through line 128 and/or in indirect heat exchange with the liquid phase portion separated in separator 42 and passed through line 44 to column 88. The indirect heat exchange also supplies heat to column 88. This mode of recycling the remaining portions of the $C_3$ and $C_4$ hydrocarbon streams and cooling the same has a number of advantages. By recycling the $C_3$ and $C_4$ stream back to the main feed gas stream as a liquid and downstream of the last separation step, rather than recombining the same with methane vapors, hereinafter referred to, in a conventional manner, the load on the methane compressors which compress the methane for recycle to the main feed gas stream is substantially reduced. Further, the refrigeration capacity of the liquid phase portion separated in separators 28, 42, 56 and 70 is also conveniently utilized in the system itself to cool the remaining $C_3$ and $C_4$ hydrocarbons to a temperature such that they may be combined with the main gas stream downstream of the last separation step. Finally, as the combined remaining $C_3$ and $C_4$ hydrocarbons are cooled by the fluids separated from the main gas stream, said fluids are also warmed to a certain extent, thus reducing the energy required to heat column 88 to vaporize a portion predominating in $C_2$ and lower boiling constituents.

The liquefied main gas stream, while a liquid at the elevated pressure previously mentioned, is preferably further cooled to a temperature such that it will be a liquid at essentially atmospheric pressure, while at the same time reducing the liquefied gas pressure to said atmospheric pressure. In addition, to the extent that significant amounts of nitrogen are present in the natural gas feed, this nitrogen is preferably also removed before recovery of the liquefied natural gas for storage and/or shipment. These objectives are accomplished by a plurality of sequential pressure reduction stages. In the first pressure reduction stage, most of the nitrogen is removed as a vapor and since this vapor stream will normally contain a substantial portion of methane, this vapor stream is normally utilized as a fuel within the liquefaction system. The remaining liquefied gas is then passed through a plurality of additional pressure reduction stages where the pressure is ultimately reduced to atmospheric pressure. In the preferred system shown in the drawings, rather than utilize a single separator for the separation of the nitrogen, two separators are employed. The nitrogen removal system is shown in the dashed box of FIG. 1. Specifically, the liquefied gas passing through line 86 is passed through a reboiler in the bottom of nitrogen removal column 130, where it supplies heat to the column for the vaporization of the nitrogen enriched stream. The liquefied natural gas then passes through an expansion valve 132, where it is expanded to vaporize a portion thereof. The expanded liquefied natural gas is then passed to separator 134 where vapors flashed from the liquefied natural gas are separated through line 136 and the remaining natural gas liquid is discharged through line 138. The flashed gas passing through line 136 is then charged to column 130 for further separation to produce a vapor phase further enriched in nitrogen which is passed through line 140 and ultimately withdrawn as a plant fuel for use within the liquefaction system. The remaining liquefied natural gas from column 130 is discharged through line 142. Rather than utilizing a nitrogen column 130 as shown in the drawing, the vapor phase from separator 134 could be passed through an expansion valve and into a separator similar to separator 134 as described in another embodiment hereof. The remaining liquefied natural gas passing through lines 138 and 142 from separator 134 and column 130, respectively, may be passed through expansion valves 144 and 146, respectively, and then combined in line 148. While a single expansion valve could be utilized in line 148, since the pressures of the liquids passing through lines 138 and 142 may be different it is most convenient to utilize individual expansion valves 144 and 146. The combined liquefied natural gas stream passing through line 148, which has been expanded to vaporize a portion thereof, is then passed to a high stage separator 150. Expansion valves 144 and 146 and separator 150 comprise an expander-separator combination similar to expander-separator 132-134. Consequently, the combined stream of liquefied natural gas passing through line 148 could be passed through a conventional heat exchanger and then be passed to a conventional high stage flash drum. However, in the preferred embodiment shown, the separator-flash drum 150 doubles as a cooler or chiller which condenses the flashed vapors passing from flash drum 134 through line 136 to column 130. High stage separator-flash drum 150 is a tube and shell type chiller constructed in essentially the same fashion as the chillers utilized to cool the feed gas with propane and ethylene or it could also be a can-type plate and fin heat exchanger. Specifically, the vapors passing through line 136 pass through the tubes of the chiller in indirect heat exchange with the fluids produced by the expansion of the expanded and partially vaporized stream introduced through line 148. In separator 150 vapors produced by the expansion of the liquefied natural gas are discharged through line 152 while the remaining liquefied natural gas in liquid phase is discharged through line 154. The liquefied natural gas passing through line 154 is expanded through expansion valve 156 into a separator or flash drum 158. Expander 156 and flash drum 158 comprise an intermediate stage expansion or flash step. The vapors flashed by the expansion through valve 156 are removed from separator 158 through line 160 while the remaining liquefied natural gas is discharged through line 162. The liquefied natural gas passing through line 162 is expanded through valve 164 into separator or flash drum 166. Expander 164 and flash drum 166 comprise a low flash stage or pressure reduction. Flashed vapors from separator 166 are discharged through line 168 while the remaining liquefied natural gas is discharged through line 170. Liquefied natural gas from line 170 is then passed to a liquefied natural gas storage means 172, as a product of the process. If desired, the liquefied natural gas may be still further expanded through expansion valve 174 to ultimately reduce the pressure of the liquefied natural gas to atmospheric pressure. Flashed vapors produced by expansion through valve 174 and/or vapors normally produced in storage means 172 are discharged through line 176. In order to utilize the refrigeration capacity of the flashed gases, produced in the pressure reduction stages, these flashed vapors are preferably passed in indirect heat exchange with the liquefied natural gas feed at appropriate points. Specifically, flashed vapors passing through line 168 from flash drum 166 and through line 160 from flash drum 158 are passed in indirect heat exchange with liquefied natural gas passing through line 154 in an indirect heat exchanger or methane interstage economizer 178. Vapors from storage means 172 passing through line 176 may then be combined with the vapors passing through line 168 following methane interstage economizer 178. Flashed vapors passing through lines 168 and 160, along with flashed vapors passing through lines 152 and 140 from high stage flash drum 150 and nitrogen column 130, respectively, may then be passed in indirect heat exchange with the main stream of liquefied natural gas passing through line 86 in indirect heat exchanger or high stage methane economizer 180. As previously indicated, the nitrogen-enriched flashed vapors passing through line 140 are then utilized as a plant fuel after passage through economizer 180. Flashed vapors passing through lines 168, 160 and 152, following their use in economizer 180, are then passed to low stage compressor 182, intermediate stage compressor 184 and high stage compressor 186, respectively, where they are compressed for recycle to the main gas stream. The recombined and compressed methane is then passed through line 188, also preferably through economizer 180, and back to the main gas stream at a point where the pressure of the recycle methane is essentially equal to the pressure of the main gas stream. In the present case the preferred point of recombination of the compressed recycle methane with the main gas stream is in line 82 between the second intermediate stage ethylene feed chiller 80 and low stage ethylene feed gas chiller 84. Finally, the $C_2$ and lower boiling constituents separated in column 88 and passing through line 94 are recombined with flashed vapors from the high stage flash means in line 152, either prior to, after, or, as shown, at an intermediate point in economizer 180.

Figure 2:
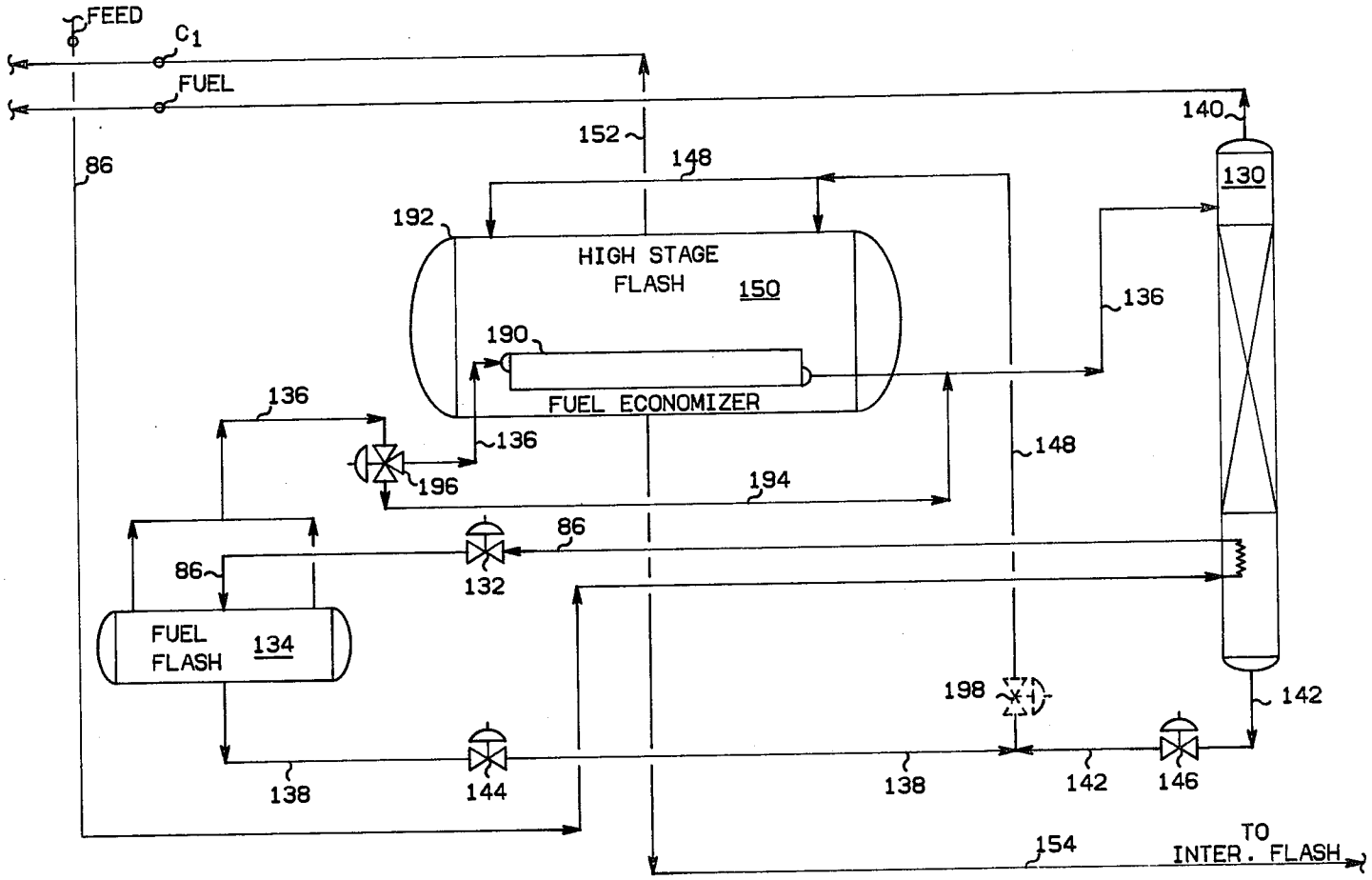
FIG. 2 is an enlarged simplified flow diagram of the nitrogen removal system of FIG. 1 in slightly greater detail.

FIG. 2 of the drawings is an enlarged view of the nitrogen removal system enclosed within the dashed box of FIG. 1, showing this system in slightly greater detail. In FIG. 2 the same numerical designations utilized in FIG. 1 have been utilized to designate the same flow lines and items of equipment which appear in both FIGS. 1 and 2.

In accordance with FIG. 2 the liquefied gas feed passing through line 86 is first passed through a reboiler mounted in the bottom of nitrogen removal column 130. The liquefied gas is then expanded through valve 132 into fuel flash drum 134. Expansion valve 132 and fuel flash drum 134 comprise a means for separating the liquefied natural gas into a first vapor phase portion and a first liquid phase portion. The first vapor phase portion then passes through line 136 and a cooling means, which here constitutes a combined high stage flash drum and fuel economizer, 150. High stage flash drum and fuel economizer 150 is basically of the same construction as the chillers utilized to initially cool and liquefy the natural gas stream with expanded propane and ethylene as generally shown in FIG. 1. Specifically, unit 150 is a tube and shell color in which the fluid to be cooled is passed through the tubes 190 of the unit in indirect heat exchange with a body of expanded, liquefied normally gaseous material contained in the shell 192 of the unit, which body of fluids acts as a cooling medium. While the tubes 190 are shown as a single unit in the drawing, in actual practice the tubes will consist of a plurality of tube bundles connected in series and/or parallel. The body of fluid contained in shell 192 comprises both liquid and gas and the tubes 190 are normally located below the liquid level.

In utilizing this particular high stage flash fuel-economizer unit 150, it is desirable in some cases to control the volume of vapor produced in column 130. This is accomplished by providing a bypass line 194 which bypasses a controlled amount of the first vapor phase portion around high stage flash fuel-economizer 150 and thus controls the temperature of the first vapor phase portion fed to column 130. The relative volumes of the first vapor phase portion passing through the tubes 190 and bypass line 194 is provided by two-way control valve 196. While the drawing does not show a control system for this purpose, U.S. Pat. No. 4,172,711 shows and describes a control system adapted to control the amount of vapor produced in a column such as column 130 in accordance with the amount of feed gas being processed by a natural gas liquefaction system. Since the vapor produced in nitrogen removal column 130 is utilized as a fuel for internal use in the liquefaction plant, such a control system thus controls the amount of fuel produced by column 130 in accordance with the needs of the plant which will, of course, depend upon the volume of gas being processed by the plant.

In this embodiment, the column 130 is a nitrogen removal column or fractionation column comprising the second separation means for separating the liquefied normally gaseous feed into a second vapor phase portion further enriched in nitrogen and a second liquid phase portion. The second vapor phase portion is passed through line 140 and recovered as a fuel for internal use within the plant as previously referred to. The first liquid phase portion from flash drum 134 is passed through line 138 and expanded by passage through valve 144. Similarly, the second liquid phase portion separated in column 130 passes through line 142 and is expanded through expansion valve 146. The expanded fluids passing through lines 138 and 142 are combined in line 148. While it is possible to expand the combined streams in line 148 through a single expansion valve, shown alternatively as valve 198, it is preferred to utilize separate expansion valves 144 and 146, since the first and second liquid phase portions passing through lines 138 and 142 will generally be at somewhat different pressures and the utilization of separate expansion valves provides better control and more effectively equalizes the two pressures. The combined first and second liquid phase portions, passing through line 148, are then passed into shell 192 of high stage flash fuel-economizer 150 to form the previously mentioned body of expanded fluid. In addition to acting as a fuel economizer to cool and at least partially condense the first vapor phase portion passing through line 136, unit 150 also acts as a high stage flash drum or the first stage of a plurality of expansion stages which reduce the pressure of the liquefied natural gas to essentially atmospheric pressure, as previously described with reference to FIG. 1. Accordingly, a third vapor phase portion comprising essentially methane is passed through line 152, utilized as a cooling medium for the incoming liquefied natural gas, compressed and ultimately recycled to the natural gas stream prior to its complete liquefaction, all as previously described with reference to FIG. 1. A third liquid phase portion separated in unit 150 is passed through line 154 to a second stage or intermediate stage pressure reduction, also as previously described with reference to FIG. 1.

Figure 3:
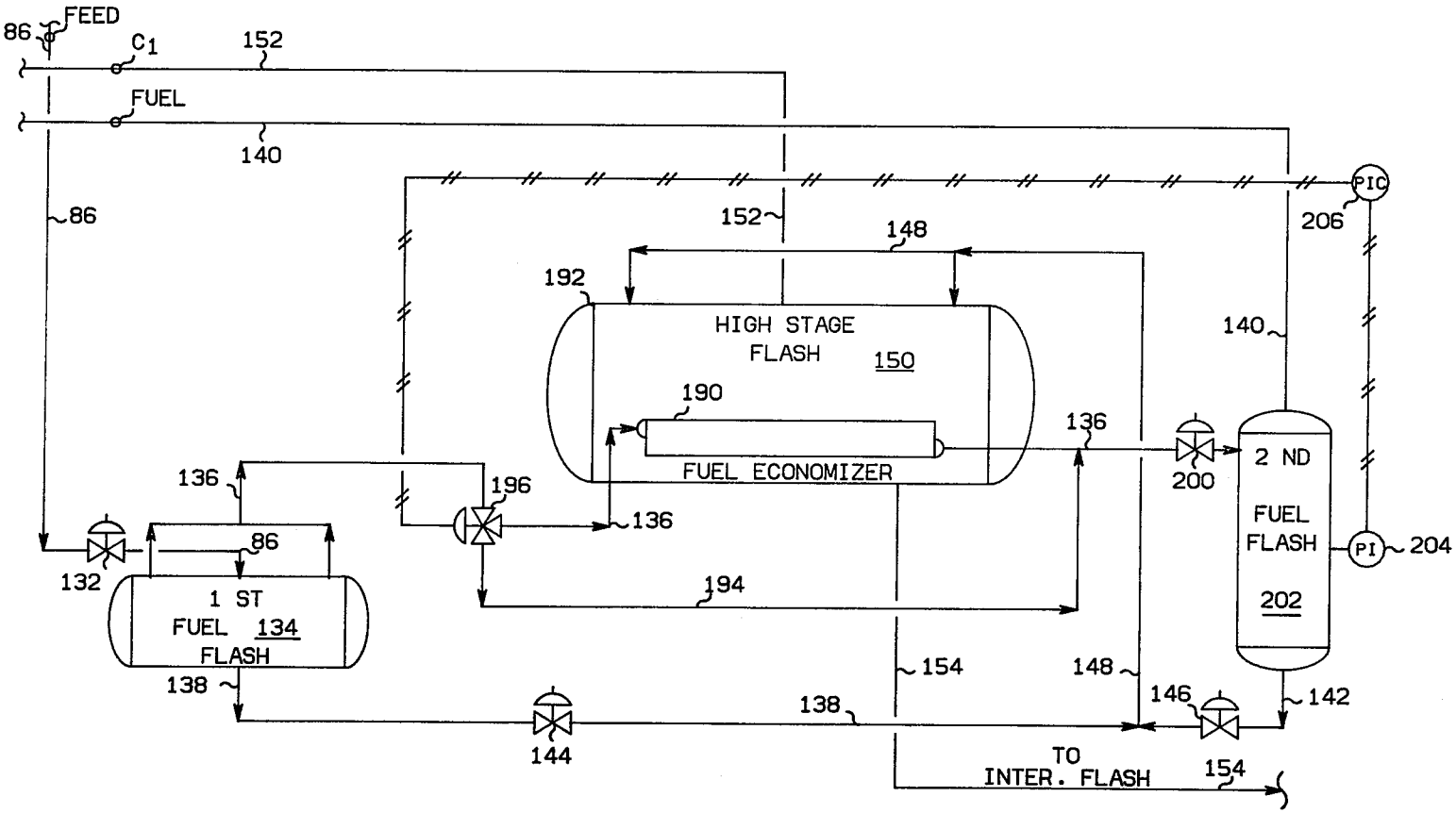
FIG. 3 is an enlarged flow diagram of another embodiment of the nitrogen removal system of the present invention.

The embodiment of FIG. 3 is similar to that of FIG. 2 and the numerical designations are repeated where applicable. The significant difference between the arrangement of FIG. 2 and that of FIG. 3 is that the latter separates the second vapor phase portion further enriched in nitrogen from the second liquid phase portion by expansion and separation of phases rather than fractionation. Specifically, the at least partially condensed first vapor phase portion enriched in nitrogen is passed through line 136 and thence through expansion valve 200, where its pressure is reduced. The reduced pressure stream is then passed to a second fuel flash drum-separator 202. In addition to the obvious advantage of simplification over a fractionation tower, the arrangement of FIG. 3 also has the advantage of better control over the amount of nitrogen removed and the total volume of fuel gas removed through line 140. In addition to the control by means of expansion valve 200 through which the degree of expansion can be controlled, the pressure within flash vessel 202 can also be controlled by controlling two-way valve 196, which proportions the volume of the first vapor phase portion enriched in nitrogen between the tubes of fuel economizer 150 and bypass line 194. This is accomplished by providing a pressure indicator 204 on the second fuel flash drum 202, which in turn is connected to pressure indicator controller 206 and ultimately to two-way valve 196. By thus providing a two fuel flash drum arrangement, one before and one after the high stage flash fuel-economizer 150, the second fuel flash drum is allowed to operate at a lower temperature, thereby allowing a higher concentration of nitrogen to go to fuel. This also reduces the concentration of nitrogen in the liquefied natural gas, thus increasing its heating value somewhat. Further, this additional removal of nitrogen in the fuel gas decreases the horsepower requirements for compression of the methane which is ultimately recycled to the natural gas feed. For example, with a natural gas having a nitrogen concentration of 0.73 percent, horsepower required to compress the recycled methane would be reduced by one percent, as compared with a conventional arrangement in which a single fuel flash is utilized in the position shown for the second fuel flash in FIG. 3 and without the first fuel flash. It was also found that a slight reduction in the horsepower required to compress the ethylene and propane refrigerants, utilized for the initial liquefaction of the natural gas, would be attained. While the percentage decrease in the horsepower requirements appears small, such a reduction is substantial when one considers the size of a natural gas liquefaction system. Further, when the gas to be processed contains a higher concentration of nitrogen, the horsepower savings referred to would be further increased.

The following table illustrates typical temperatures and pressures for operation of the nitrogen removal system illustrated in FIG. 2:

TABLE II

| Flow Line or Equipment Item | Temp., °F. | Pressure, psia |
|---|---|---|
| 86 | −144 | 546 |
| 136 | −160 | 335 |
| 130 | −170 | 331 |
| 140 | −170 | 331 |
| 142 | −161 | 331 |
| 138 | −160 | 335 |
| 148 | −187 | 179 |
| 152 | −187 | 177 |
| 154 | −186 | 177 |

The following table illustrates typical temperatures and pressures for operation of the nitrogen removal system illustrated in FIG. 3:

TABLE III

| Flow Line or Equipment Item | Temp., °F. | Pressure, psia |
|---|---|---|
| 86 | −145 | 481 |
| 136 | −154 | 335 |
| 202 | −160 | 332 |
| 140 | −160 | 332 |
| 142 | −160 | 332 |
| 138 | −154 | 335 |
| 148 | −184 | 170 |
| 152 | −184 | 170 |
| 154 | −183 | 170 |

Figure 4A:
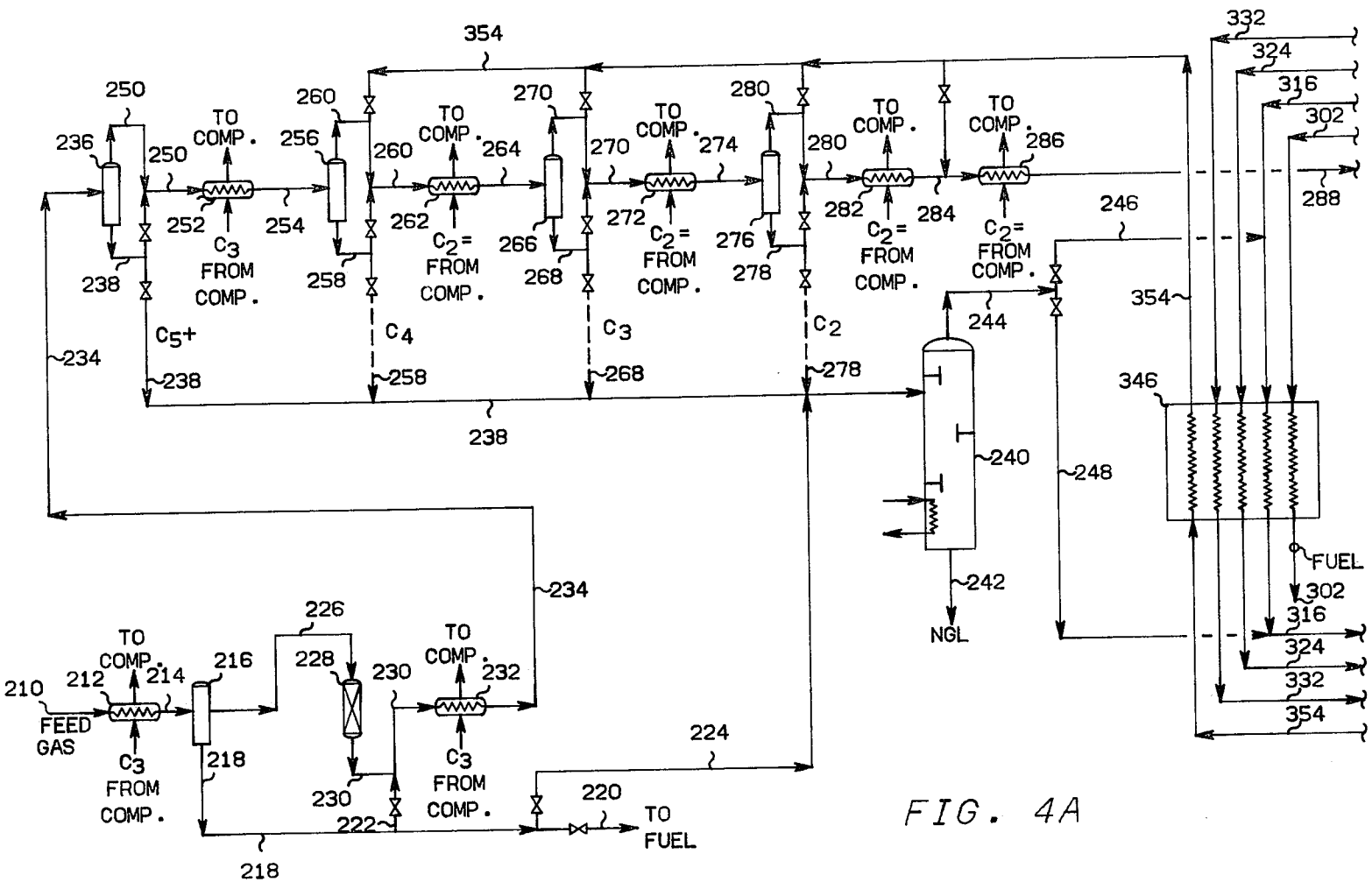
FIG. 4A, B, is a simplified flow diagram of a natural gas liquefaction system including a further embodiment of the nitrogen removal system of the present invention.
Figure 4B:
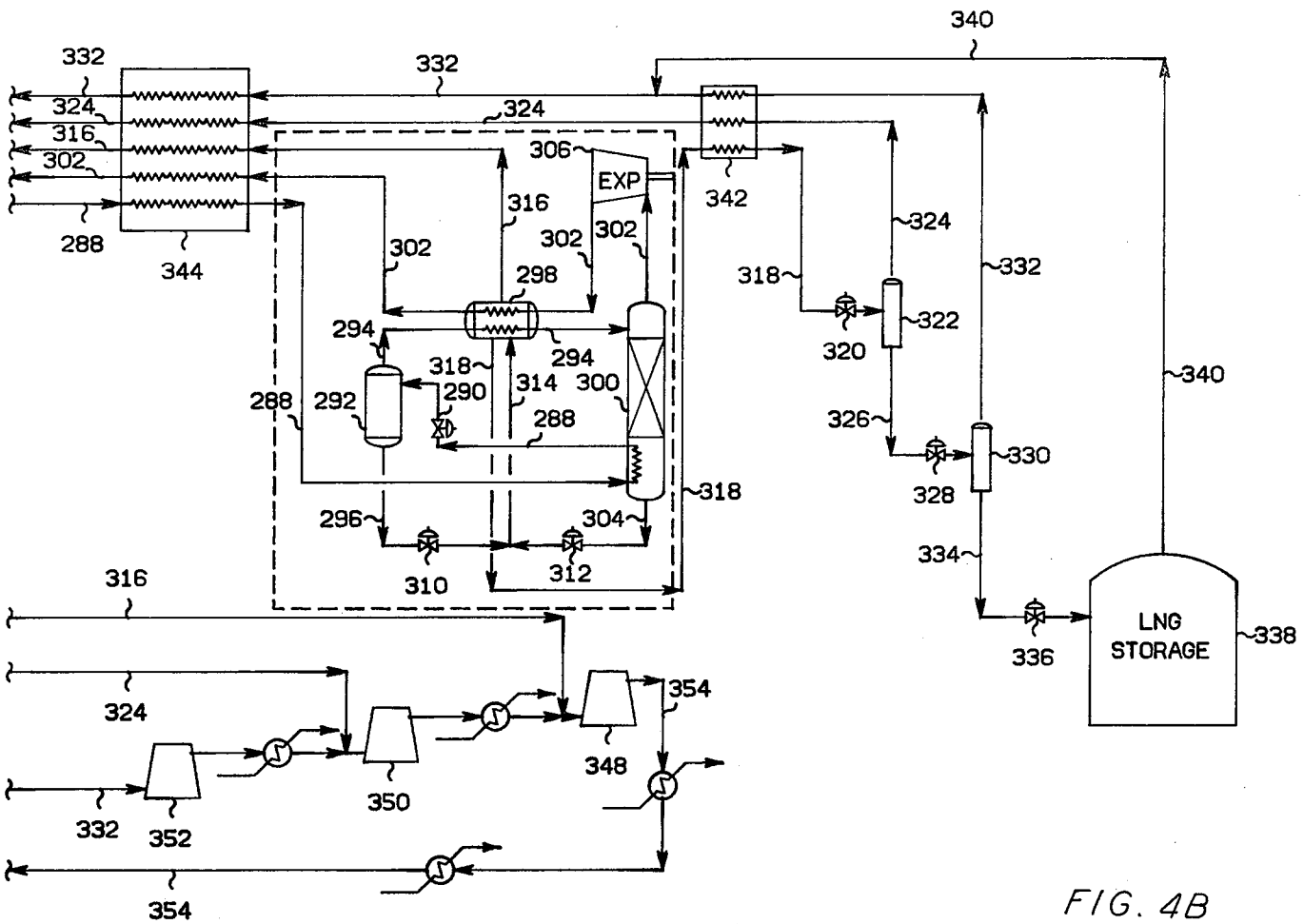

FIG. 4 of the drawings is a flow diagram of another system for the liquefaction of a natural gas in which the arrangement for separating $C_2$ and higher molecular weight hydrocarbons from the natural gas differs from that of FIG. 1, an additional economizer is utilized, which aids in cooling the methane recycled to the natural gas feed, a different compressor system is utilized for compression of the recycle methane and another embodiment of the system for removing nitrogen from the liquefied natural gas is shown.

Obviously, the previously described embodiments of the system for the removal of nitrogen from the liquefied natural gas feed could be utilized in the arrangement such as that shown in FIG. 4 as well as that shown in FIG. 1 and the hereinafter described embodiments of the system for the removal of nitrogen from the liquefied natural gas can be utilized in arrangements such as that of FIG. 1 even though they are described in detail with reference to FIG. 4.

A typical natural gas feed which can be processed in the arrangement shown in FIG. 4 would have the following composition:

TABLE IV

| Component | Mol % |
|---|---|
| $N_2$ | 6.01 |
| $C_1$ | 83.65 |
| $C_2$ | 6.86 |
| $C_3$ | 2.15 |
| $C_4$ | 0.80 |
| $C_5$+ | 0.32 |
| He | 0.21 |

With reference to FIG. 4 of the drawing, it is to be understood that the feed gas has been subjected to conventional treatment to remove acid gases such as $CO_2$ and $H_2S$. It is also to be understood that the gas has been compressed to a high pressure, if it is not already at a sufficiently high pressure, between about 300 and 1500 psia and typically between about 500 and 900 psia. In accordance with FIG. 4, the natural gas feed is introduced to the system through line 210. The feed gas then passes in indirect heat exchange with a body of fluids produced by expanding liquefied propane in a tube and shell type high stage propane feed gas chiller 212. Compressed and liquiefied propane utilized as the refrigerant is supplied from a conventional compression-refrigeration system, not shown. The cooled feed gas then passes through line 214 to a vapor-liquid separator 216 which, in this case, is a dehydrator inlet separator which removes condensed water. Gaseous and liquid hydrocarbons separated from the natural gas feed in separator 216 would be discharged through line 218 and by further recovery means (not shown) could be withdrawn as a fuel through line 220 or, alternatively, recycled to the natural gas stream through line 222 or through line 224. The main natural gas stream is discharged from separator 216 through line 226 to dehydrator 228. A dehydrator-regeneration system, normally associated with dehydrator 228, is not shown. The dehydrated main gas stream then passes through line 230 to interstage propane feed gas chiller 232. The further cooled main gas stream from chiller 232 is passed through line 234. At the temperature and pressure existing at this point, the $C_5$ and higher molecular weight hydrocarbons present in the natural gas stream will generally be condensed. Consequently, the natural gas stream is passed to vapor-liquid separator 236. In separator 236, the condensed liquid portion is separated and discharged through line 238. This condensed liquid stream will also carry over a certain amount of lower molecular weight hydrocarbons, namely, $C_4$ and lower molecular weight hydrocarbons. Therefore, the condensed liquid is passed to a separator which, in this case, is a fractionation column 240. Fractionation column 240 can be a fractionation column having a plurality of trays or a packing to provide intimate contact between rising vapors and descending liquids. Column 240 is also appropriately heated. Column 240 is operated at a temperature and pressure sufficient to separate a natural gas liquids portion, comprising essentially $C_5$ and higher molecular weight hydrocarbons, which is recovered as a product through line 242, from a vapor phase portion, comprising $C_4$ and lower boiling hydrocarbons, which is discharged through line 244. The $C_4$ and lower molecular weight hydrocarbons can then be passed either through line 246 or 248 and ultimately recycled to the main natural gas stream, as hereinafter described. The main gas stream or vapor phase separated in separator 236 is then passed through line 250 to low stage propane-feed gas chiller 252. Depending upon the operating temperature of chiller 252, additional components of the natural gas will be condensed. For example, chiller 252 can be at a temperature such that both $C_4$ and $C_3$ hydrocarbons will be condensed. The cooled natural gas stream from chiller 252 is passed through line 254 and may be passed to a vapor-liquid separator 256. Vapor-liquid separator 256 will thus separate a condensed liquid phase portion and discharge the same through line 258. This liquid phase portion may then be added to the liquid phase portion passing through line 238 and fed to fractionator 240. In this alternative mode of operation, column 240 would separate $C_2$ and lower boiling constituents as a vapor phase and pass the same through line 244 and $C_3$ and higher molecular weight hydrocarbons would be separated as a liquid phase portion. The liquid phase portion could then be passed to a second fractionation column (not shown) where $C_3$ and $C_4$ hydrocarbons would be recovered as a vapor phase and the $C_5$ and higher molecular weight natural gas liquids as a liquid phase. The $C_3$ and $C_4$ hydrocarbons could be either recycled to the main gas stream or recovered as a product of the process and utilized as a single or separate liquefied petroleum gas (LPG). The vapor phase main gas stream from separator 256 is passed through line 260 to high stage ethylene-feed gas chiller 262. To the extent that separator 256 is not utilized, the main gas stream would pass from chiller 252 directly to chiller 262. Again depending upon the temperature of operation of chiller 262 and the desires of the operator, the further cooled main gas stream could be passed through line 264 to a third vapor-liquid separator 266. To the extent that separator 266 is utilized, the system would be operated so as to condense a liquid phase portion comprising primarily $C_4$ hydrocarbons by means of chiller 252 and a liquid phase portion comprising essentially $C_3$ and lighter hydrocarbons in chiller 262. Condensed liquid phase portion from separator 266 can be passed through line 268 and combined with condensed liquids through lines 238 and 258, respectively. If this alternative is utilized three or four series connected fractionating columns such as 240 could be utilized, again depending upon the desired separation of the heavier hydrocarbons. For example, separator 240 could recover $C_2$ and lower boiling constituents as a vapor phase and feed the remaining liquid phase to a second separator which in turn would separate $C_3$ hydrocarbons as a vapor phase and feed the remaining liquid phase to the third column which would separate $C_4$ hydrocarbons as an overhead and $C_5$ and higher molecular weight natural gas liquids as a final liquid phase. The recovered $C_3$ and $C_4$ hydrocarbons could be withdrawn from the system and utilized for other purposes such as, as fuels, as chemical feeds or, in the case of the propane, as a refrigerant in the system. In this particular case the volume of $C_1$ and $C_2$ hydrocarbons separated along with the separated liquid phase portions and fed to column 240 would be relatively small. However, again depending upon the cooling conditions, the volumes of these materials could be significant and a fourth fractionation column could be added as will be detailed hereinafter. In this instance $C_1$ and lower boiling constituents would be recovered as a vapor phase in column 240 and the remainder of the liquid phase fed to the second fractionation column. The second fractionation column would separate $C_2$'s as a vapor phase and the remaining liquid portion would be fed to the third fractionation column. The $C_1$ and $C_2$ vapor phases could be then recycled to the main gas steam or the $C_2$ vapors collected as a product. The third fractionation column could separate $C_3$ hydrocarbons as a vapor phase and feed the remaining liquid phase to the fourth fractionation column. The fourth fractionation column would, in turn, separate $C_4$ hydrocarbons as a vapor phase and the $C_5$ and higher molecular weight natural gas liquids as a liquid phase. The vapor phase portion of the main gas stream from separator 266 is passed through line 270 to interstage ethylene-feed gas chiller 272. The main gas stream from chiller 272 is passed through line 274 and can then be passed through a fourth vapor-liquid separator 276, if desired. To the extent that separator 276 is employed, the system would be operated so as to condense essentially $C_3$ hydrocarbons in chiller 262 and $C_2$ and some lower boiling constituents in chiller 272. In this case the condensed liquid phase portion would be passed through line 278 and combined with the condensed liquid passing through lines 238 and/or 258 and/or 268 to fractionating column 240. In this particular case, the previously described series connected four fractionating columns would be utilized in a manner previously described to separate the condensed liquids. The vapor phase portion from separator 276, comprising the main gas stream, is passed through line 280 to interstage ethylene-feed gas chiller 282. To the extent that separator 276 were not utilized the feed gas would of course be passed directly from chiller 272 to chiller 282. After passing through chiller 282 the feed gas stream is then passed through line 284 to low stage ethylene-feed gas chiller 286. At this point the natural gas feed is essentially liquefied at a pressure only slightly lower than the initial pressure of the feed gas. The liquefied natural gas is passed from chiller 286 through line 288.

Liquefied natural gas feed is now treated, in accordance with the present invention, for the removal of nitrogen therefrom. In FIG. 4, a nitrogen separation system, in accordance with the present invention, is enclosed within the dashed box. Specifically, the liquefied natural gas passing through line 288 is subjected to a first separation in which a first vapor phase enriched in nitrogen is separated from a first liquid phase portion comprising the liquefied main gas stream. In the particular instance shown, this separation comprises an expansion of the liquefied natural gas to flash a portion of the gas as the first vapor phase enriched in nitrogen. Specifically, the liquefied natural gas is passed through an expansion valve 290 and thence to a fuel flash drum 292. From fuel flash drum 292 a first vapor phase portion enriched in nitrogen is withdrawn through line 294 and the remaining liquefied natural gas stream is withdrawn through line 296. The first vapor phase portion enriched in nitrogen is then cooled in fuel gas economizer 298, to at least partially condense the vapor. Fuel gas economizer 298 may be of various forms, as will be explained in detail hereinafter. The cooled first vapor phase portion, enriched in nitrogen, is then subjected to a second separation wherein a second vapor phase portion further enriched in nitrogen is separated from the liquefied main gas stream. In the particular instance shown, the second separation step comprises a fractionation step in nitrogen removal column 300. Nitrogen removal column 300 is heated to an appropriate temperature preferably by passing the liquefied natural gas passing through line 288 through a reboiler in the bottom of column 300 prior to the expansion of the liquefied natural gas through expansion valve 290. Column 300 is also preferably a plural tray column or a packed column to provide intimate contact between rising vapors and descending liquids. A second vapor phase portion further enriched in nitrogen is discharged through line 302 and the remaining liquefied natural gas stream is discharged through line 304. The second vapor phase portion further enriched in nitrogen is then expanded to reduce the pressure thereof and further cool this portion. In the particular instance shown in the drawing, this expansion takes place in an expander portion 306 of a turboexpander-compressor. The expanded second vapor phase, further enriched in nitrogen, is then passed in indirect heat exchange with the first vapor phase portion passing through line 294 in fuel economizer 298. Accordingly, the expansion of the second vapor phase portion, further enriched in nitrogen, makes available the shaft horsepower of expander 306, which may be utilized within the system for compressing various gas streams, such as the hereinafter mentioned recycle methane stream. Further, such expansion also provides at least part of the cooling for the at least partial condensation of the first vapor phase portion enriched in nitrogen and passing through line 294. The two stage separation before and after fuel economizer 298, carried out by expansion valve 290 and fuel flash drum 292 and nitrogen removal column 300, respectively, also has numerous advantages. Specifically, a two stage separation arrangement increases the amount of nitrogen removed from the liquefied natural gas, permits the operation of the second separation step at a lower temperature, significantly reduces the horsepower required for the hereinafter discussed compression of the recycle methane and to some extent reduces the horsepower required for the compression of the propane and ethylene refrigerants utilized in the initial liquefaction of the natural gas feed. A further distinct advantage of the use of expander 306 is to shift the refrigeration load further upstream in the liquefaction cooling cycle. For example, a part of the refrigeration load which normally would be carried by a low stage ethylene feed gas chiller 286 can be shifted back to intermediate stage ethylene-feed gas chiller 282. As previously pointed out, fuel gas economizer 298 can take various forms. In the particular instance shown, fuel gas economizer 298 is a combination high stage flash drum and fuel gas economizer. Thus, fuel gas economizer 298 is a part of the first stage of a plurality of pressure reduction stages which ultimately reduce the pressure of the liquefied natural gas to essentially atmospheric pressure for storage and transportation. Specifically, this pressure reduction is performed by passing the main liquefied natural gas from line 296 through pressure reduction valve 310. Similarly, the liquid phase portion passing through line 304 is passed through pressure reduction valve 312. The two reduced pressure streams are then combined in line 314 and the combined, expanded fluid stream from line 314 is fed to the high stage flash drum forming a part of fuel economizer 298. The expanded body of fluid comprises both vapor and liquid in flash drum 298 and the fluids passing through lines 294 and 302 will normally be passed through tubes of the fuel economizer, which are normally below or at least partially below the surface of the liquid. In any event, the fuel flash drum portion of fuel economizer 298 operates in essentially the same manner as fuel flash drum 292. Consequently, a vapor phase portion is separated from the expanded body of fluids and is discharged through line 316 and the remaining main stream of liquefied natural gas, in the liquid phase, is discharged through line 318. The main liquefied natural gas stream passing through line 318 is then subjected to a second expansion stage comprising passage through expansion valve 320 and into interstage flash drum 322. Flashed vapors are discharged from intermediate stage flash drum 322 through line 324, while the main liquefied natural gas stream, in liquid phase, is passed through line 326. The liquefied natural gas from line 326 is again expanded through expansion valve 328 and passed to low stage drum 330. In the low stage flash drum 330 flashed vapors are separated and withdrawn through line 332 and the main liquefied natural gas stream, in liquid phase, is withdrawn through line 324. The liquefied natural gas stream passing through line 334 may again be expanded through expansion valve 336 and then passed to a liquefied natural gas storage facility 338. To the extent that the pressure of the liquefied natural gas passing through line 334 is essentially atmospheric pressure, expansion valve 336 may be eliminated. In any event, whether expansion valve 336 is utilized or not, certain amounts of gas will vaporize from the liquefied natural gas in storage unit 338. This vapor phase stream is withdrawn through line 340. The multiple expansion procedure just described has the distinct advantage of permitting the recovery of the cooling potential of the flashed and vaporized gases. Accordingly, the flashed vapors passing through lines 324 and 332, which comprise principally methane, are passed in indirect heat exchange with the main liquefied natural gas stream passing through line 318 in heat exchanger or low stage methane economizer 342. Similarly, flashed gases passing through line 324 and line 332, as well as the flashed gas passing through line 316 and the flashed gas passing through line 302, which constitutes the nitrogen-enriched fuel gas, are passed in indirect heat exchange with the liquefied natural gas stream passing through line 288 in heat exchanger or high stage methane economizer 344. The gases passing through line 302, which is the nitrogen enriched fuel gas, and through lines 316, 324 and 332 which comprise methane flashed from the high stage, intermediate stage and low stage pressure reduction stages, which is principally methane, can be utilized to cool the hereinafter mentioned recycle methane stream by passing the former gases in indirect heat exchange with the recycle methane in additional methane economizer 346. Since the vapor phase separated in column 240 and passing through lines 246 and/or 248 is at essentially the same pressure as flashed gas from the high stage expansion passing through line 316, gases from column 240 may be added to the flashed high stage methane either before and/or after methane economizer 346. Obviously, the gas from tower 240 may be added to any of the other methane streams for ultimate recycle when its pressure is essentially the same as that of the recycled gas to which it is added. The flashed methane passing through lines 316, 324 and 332 is then recompressed. Specifically, the high stage flashed gas in line 316 is compressed in high stage compressor 348, the intermediate stage flashed gas from line 324 is compressed in intermediate stage compressor 350 and the low stage flashed gas passing through line 332 is compressed in low stage compressor 352. As is apparent from the drawing, the high stage, intermediate stage and low stage compressors are connected in series so that the compressed low stage gas is combined with the intermediate stage gas and passed to the intermediate stage compressor and the compressed low stage and intermediate stage gas from compressor 350 is combined with the high stage flashed gas and passed to the high stage compressor 348. The compressed gas is then passed through line 354, cooled if desired by means of water coolers or other means, and passed through methane economizer 346 in indirect heat exchange with the flashed gases prior to the compression of the latter. The thus cooled, compressed methane is then recombined or recycled to the main gas stream prior to the liquefaction thereof. As shown in the drawing, there are a number of places at which the recycled methane may be combined with the main gas stream, depending upon the temperature and pressure of the recycled gas stream. Specifically, the temperature of the recycled gas stream should be approximately equal to the temperature and pressure of the main gas stream at the point at which it is recycled or recombined.

The nitrogen recovery system just described is particularly useful where the nitrogen enriched fuel gas recovered through line 288 does not need to be at a high pressure. For example, in some instances the fuel gas is utilized to operate gas turbines such as a gas turbine to operate compressors 348, 350 and 352. However, it is possible to replace the gas turbines with steam turbines. In this latter instance boilers of the steam turbines do not require that the fuel gas be at a high pressure and therefore the gas can be at a lower pressure than in the previous instance. In fact, the pressure of the fuel gas can be reduced to the lowest possible pressure which will cause flow through the equipment and to the boilers of the steam turbines. Thus, a substantial reduction in pressure can be effected through expander 306, significantly reducing the temperature of the gas for use in fuel economizer 298 and methane economizers 344 and 346. Utilizing the refrigeration potential of the expanded, nitrogen enriched fuel gas passing through line 302 in fuel economizer 298 permits the fuel flash system 290 and 292 to operate at a slightly lower pressure and increases the refrigeration from the fuel which is available in the methane economizer 344. Both of these help to decrease the amount of nitrogen recycled through the methane compressors 348, 350 and 352 and increase the amount of nitrogen separated in column 300 and passed to fuel gas. This is particularly important where a high nitrogen content natural gas feed is being processed, or example, one having 0.21 percent helium and 6.01 percent nitrogen. Overall, recovering the additional refrigeration from the fuel gas and reducing the amount of nitrogen recycled with the methane recycle stream, the horsepower required per unit of liquefied natural gas processed is significantly reduced. Also since the expanded fuel gas is utilized in economizer 344 to additionally cool liquefied natural gas feed and this expanded fuel gas is at a lower temperature than normal, the amount of compression necessary to compress the refrigerants used for liquefying the gas, namely, the propane and ethylene, can also be reduced to a significant extent.

Figure 5:
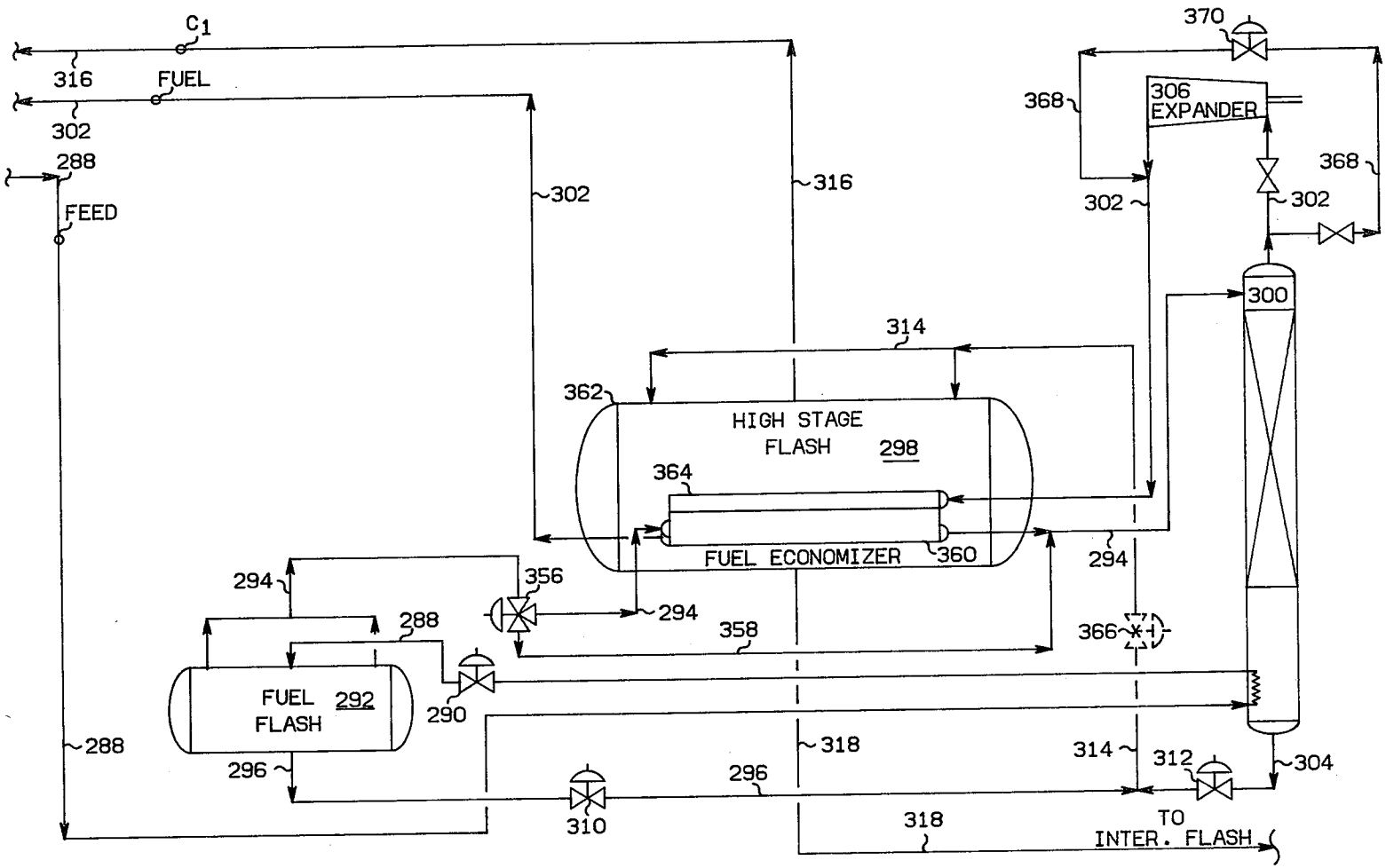
FIG. 5 is an enlarged view of the nitrogen removal system of FIG. 4 in slightly greater detail.

FIG. 5 is an enlarged view, in slightly greater detail, of the nitrogen separation system enclosed within the dashed box of FIG. 4. In FIG. 5 the same numerical designations have been utilized to indicate the equivalent flow lines and items of equipment appearing in FIG. 4. Referring specifically to FIG. 5, the first vapor phase portion enriched in nitrogen withdrawn from fuel flash drum 292 and passing through line 294 passes through two-way control valve 356 which can be utilized to proportion the first vapor phase portion through line 294 to high stage flash-fuel economizer 298 or through a bypass line 358, which bypasses the fuel economizer. This control valve 356 and bypass line 358 permit one to operate in several different ways. In one particular arrangement, the first vapor phase portion can be proportioned between fuel economizer 298 and bypass line 358 by a control system which controls the volume of gas produced as a vapor in column 300 and passing through line 302, in accordance with changes in the volume of natural gas feed to the liquefaction system. Such a control system is shown and described in detail in U.S. Pat. No. 4,172,711. Accordingly, when the volume of natural gas being liquefied is reduced below a predetermined value less fuel gas will be needed for use in the liquefaction system and control valve 356 will be operated so as to pass more gas through fuel economizer 298 and thus feed a colder gas to column 300. Alternatively, when the volume of natural gas being liquefied increases above a predetermined volume, more fuel gas will be needed by the liquefaction system, control valve 356 will be operated to bypass more gas through bypass line 358 and feed a warmer gas stream to column 300, thus producing a larger volume of vapor phase fuel gas through line 302. The combined high stage flash drum and fuel economizer 298 is constructed in the manner of a tube and shell type heat exchanger such as those utilized to liquefy the gas with the propane and ethylene refrigerants. Specifically, the first vapor phase portion enriched in nitrogen passing through the fuel economizer 298 passes through tubes 360. While a single tube bundle is shown schematically in the drawing, in most instances the tubes 360 would comprise a plurality of tube bundles connected in series and/or parallel. The first liquid phase portion passing through line 296 and the second liquid phase portion passing through line 304 and expanded through expansion valves 310 and 312, respectively, are combined in line 314 and fed into the shell 362 of high stage flash-fuel economizer 298. Thus, a body of expanded, fluid comprising both vapor and liquid, is present in the shell 362. Preferably the tube bundles 360 would be located below the liquid level in shell or drum 362. Thus, the expanded body of fluids in shell 362 provides a part of the cooling for the first vapor phase portion, enriched in nitrogen, passing through the tube bundles 360. As previously indicated, another portion of the cooling of the first vapor phase portion, enriched in nitrogen, is also provided by the expanded second vapor phase portion further enriched in nitrogen and passing through line 302. The second vapor phase portion, further enriched in nitrogen, is passed through tubes 364 of high stage flash-fuel economizer 298. The tubes 364 are constructed in a manner similar to tubes 360 and may therefore comprise a plurality of tube bundles in series and/or parallel. Rather than utilizing individual expansion valves 310 and 312 to expand liquid phase portions passing through line 296 and 304, respectively, the combined stream passing through line 314 can be expanded through a single expansion valve 366. However, the two separate expansion valves are preferred since the streams passing through lines 296 and 304 will generally be at different pressures and separate valves can be more effectively utilized to equalize the pressures prior to combining the two streams. FIG. 5 also shows an alternate means of expanding the second vapor phase portion, which is further enriched in nitrogen and which comprises the fuel gas stream. Specifically, instead of utilizing the expander portion 306 of a turbo-expander-compressor, the second vapor phase portion further enriched in nitrogen can be passed through line 368 and expanded through an expansion valve 370. This alternative will, of course, reduce equipment costs and simplify the system but, by the same token, the shaft horsepower of expander 306 will not be available.

Figure 6:
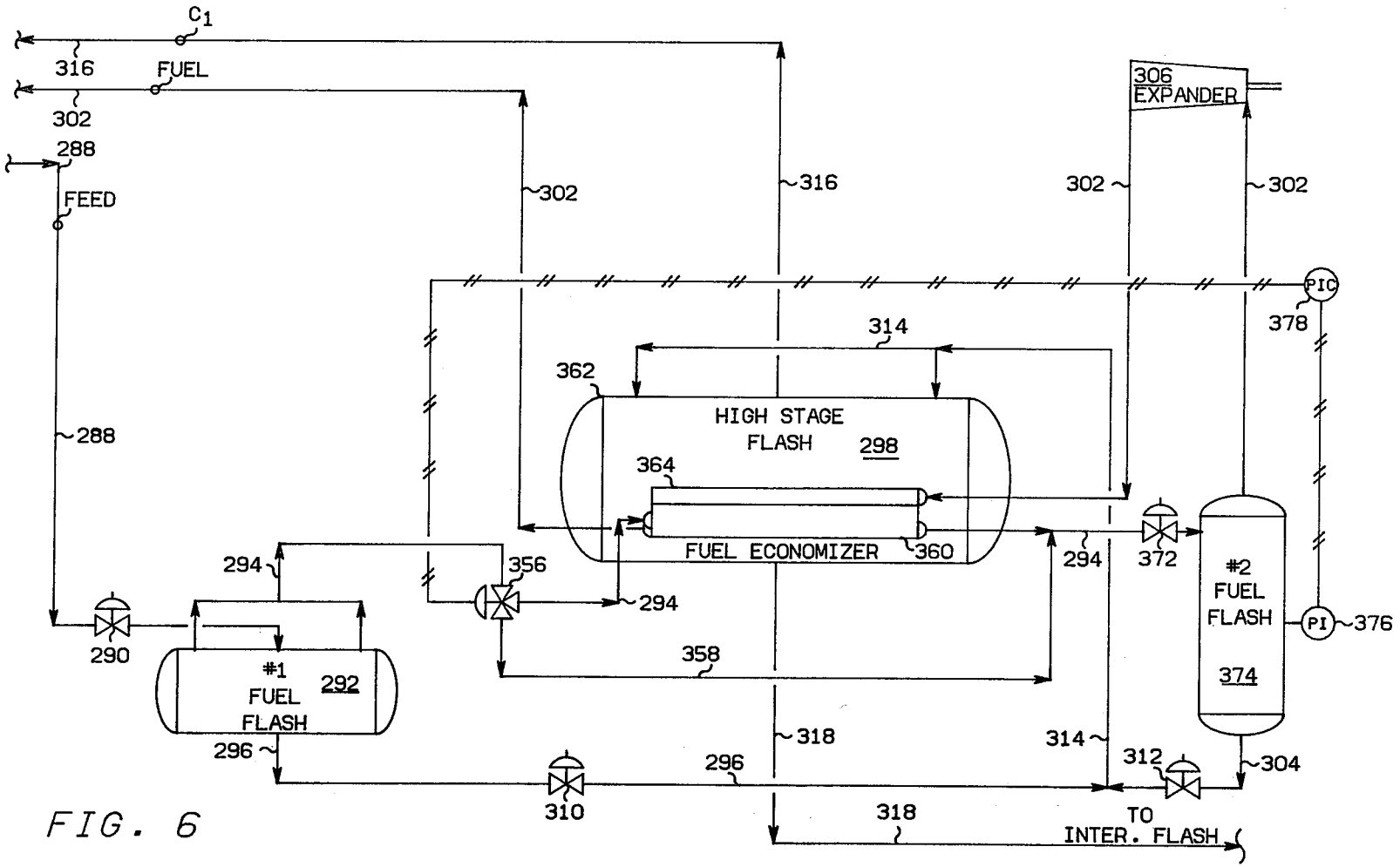
FIG. 6 is a flow diagram of another embodiment of the nitrogen removal system of the present invention.

FIG. 6 shows another embodiment of the system shown in FIG. 5. Again the same numbers are utilized on the same flow lines and items of equipment in FIGS. 5 and 6. The system of FIG. 6 differs from that of FIG. 5 primarily to the extent that expansion is utilized to separate the second vapor phase portion, further enriched in nitrogen, from the second liquid phase portion, rather than fractionation as shown in FIG. 5. Specifically, the cooled and at least partially condensed first vapor phase portion enriched in nitrogen and passing through line 294 and/or 358 is expanded through expansion valve 372 and thence into second fuel flash drum 374. The flashed second vapor phase portion, further enriched in nitrogen, is withdrawn from flash drum 374 through line 302 and is thereafter processed as previously described with reference to FIG. 5. Similarly, the remaining second liquid phase portion separated in fuel flash drum 374 is withdrawn through line 304 and processed as previously described. Effecting the second separation by expansion through valve 372 and separation in flash drum 374 will, of course, significantly simplify and reduce the cost of equipment over the use of a fractionation column. This system also has the additional advantage of better control over the amount of nitrogen separated from the liquefied natural gas. As previously described, the control valve 356 can be operated to control the temperature of the first vapor phase portion enriched in nitrogen which is fed to the flash drum 374. In addition, expansion valve 372 can at least partially control the pressure of the fuel flash drum and hence the amount of fluid flashed. In addition, FIG. 6 shows a control system for valve 356 which is controlled in accordance with the pressure within the second fuel flash drum 374. Specifically, the pressure in flash drum 374 is measured by pressure indicator means 376. Pressure indicator 376 sends a signal to pressure indicator control means 378 which in turn controls two-way control valve 356. The utilization of two fuel flash drums 292 and 374 before and after the fuel economizer 298 has a number of advantages. This system permits the second fuel flash drum 374 to operate at a lower temperature, thus vaporizing a larger volume of nitrogen and rejecting the same in the second vapor phase portion which ultimately becomes the fuel stream. By thus removing more nitrogen from the liquefied natural gas, the heating value of the liquefied natural gas will also be slightly increased. This system also has the additional advantages of reducing the horsepower required for the compression of the recycle methane by compressors 348, 350 and 352 as well as the horsepower requirements of the compressors which compress the propane and ethylene refrigerants utilized to initially cool and liquefy the natural gas. For example, if the natural gas to be liquefied has a nitrogen concentration of about 0.73 percent the horsepower required to compress the recycle methane is reduced approximately one percent as compared with a conventional system in which a single fuel flash positioned as shown by fuel flash 374 in FIG. 6 is utilized and the number one fuel flash is not utilized. Of course, at higher nitrogen concentrations in the natural gas to be processed the horsepower savings will be even greater. While the percentage reduction in horsepower appears small, the energy requirements are actually quite large when one considers the volume of natural gas processed in a typical natural gas liquefaction system.

Figure 7:
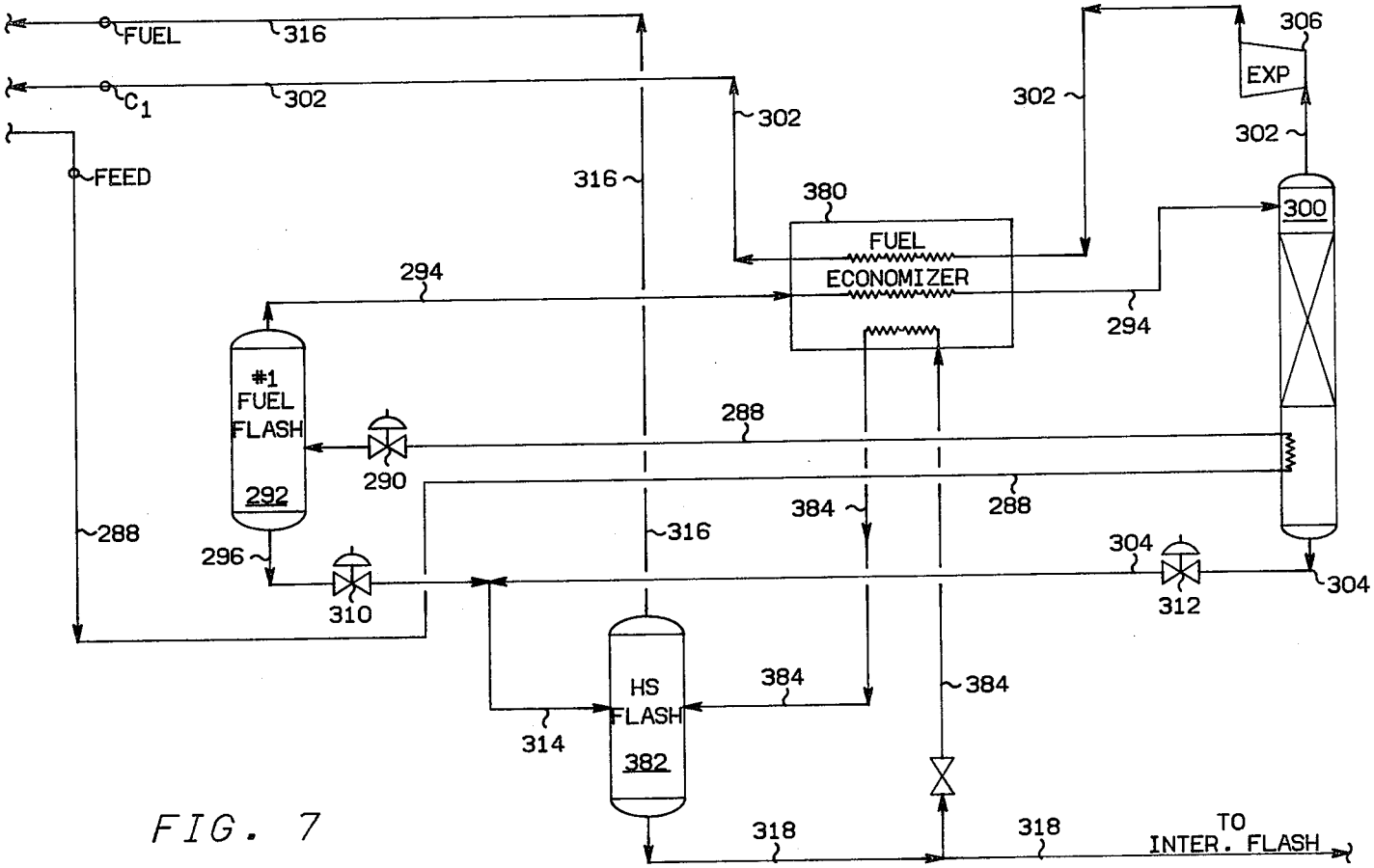
FIG. 7 is a flow diagram of yet another embodiment of the nitrogen removal system of the present invention.

FIG. 7 of the drawings shows yet another embodiment of the present invention similar to that of FIG. 5. The embodiment of FIG. 7 differs from that of FIG. 5 to the extent that a separate fuel economizer and high stage flash drum are utilized. In accordance with FIG. 7, the first vapor phase portion, enriched in nitrogen and passed through line 294, is cooled and at least partially condensed by indirect heat exchange with the expanded second vapor phase portion passing through line 302 in a conventional heat exchanger or economizer 380. The expanded first liquid phase portion and the expanded second liquid phase portion passing through lines 296 and 304, respectively, and combined in line 314 are passed to high stage flash drum 382 which separates the combined stream into the third vapor phase portion comprising the high stage methane stream 316 and main liquefied normally gaseous stream passing through line 318. In this particular arrangement, additional cooling of the first vapor phase portion enriched in nitrogen and passing through line 294 and heat exchanger 380 can be supplied by withdrawing a portion of the liquefied natural gas from the main stream passing through line 318 and passing the same through line 384 and heat exchanger 380 and back to high stage flash drum 382.

Figure 8:
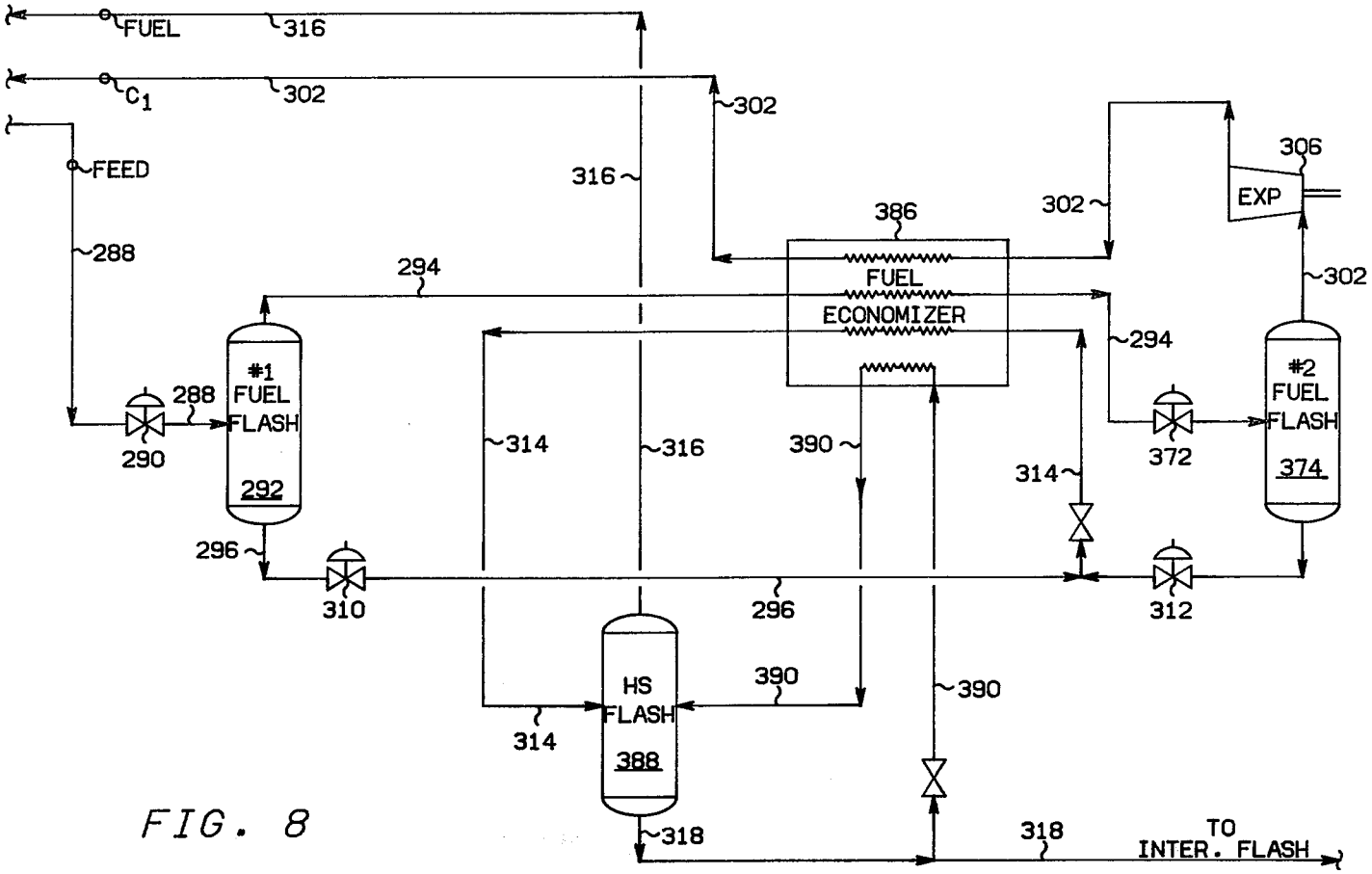
FIG. 8 is a flow diagram of another embodiment of the nitrogen removal systm of the present invention.

FIG. 8 of the drawings shows another embodiment of the present invention similar to the embodiment shown in FIG. 6. This particular embodiment differs from that of FIG. 6 to the extent that a separate fuel economizer and high stage flash drum are utilized rather than the combined high stage flash drum fuel economizer 298 of FIG. 6. In accordance with the system of FIG. 8, the first vapor phase portion, enriched in nitrogen and passing through line 294, is cooled in a conventional heat exchanger 386 by countercurrent heat exchange with the expanded second vapor phase portion, further enriched in nitrogen and passing through line 302. The first liquid phase portion passing through line 296 and the second liquid phase portion passing through line 304 are expanded through expansion valves 310 and 312, respectively, combined in line 314 and fed to high stage flash drum 388. High stage flash drum 388 separates the combined stream into the third vapor phase portion comprising the high stage methane stream passing through lines 316 and the main liquefied natural gas stream passing through line 318. In a manner similar to the operation of the system of FIG. 7, a portion of the main liquefied natural gas stream may be withdrawn from line 318, passed through line 390, through heat exchanger or fuel economizer 386 and thence back to high stage flash drum 388. FIG. 8 of the drawings shows a modification in which the expanded combined first liquid phase portion and second liquid phase portion passing through line 314 may be utilized to provide part of the cooling of the first vapor phase portion passing through line 294. This, of course, is accomplished by passing the combined first and second liquid phase streams through heat exchanger or fuel economizer 386 prior to feeding the combined stream to high stage flash drum 388.

Figure 9:
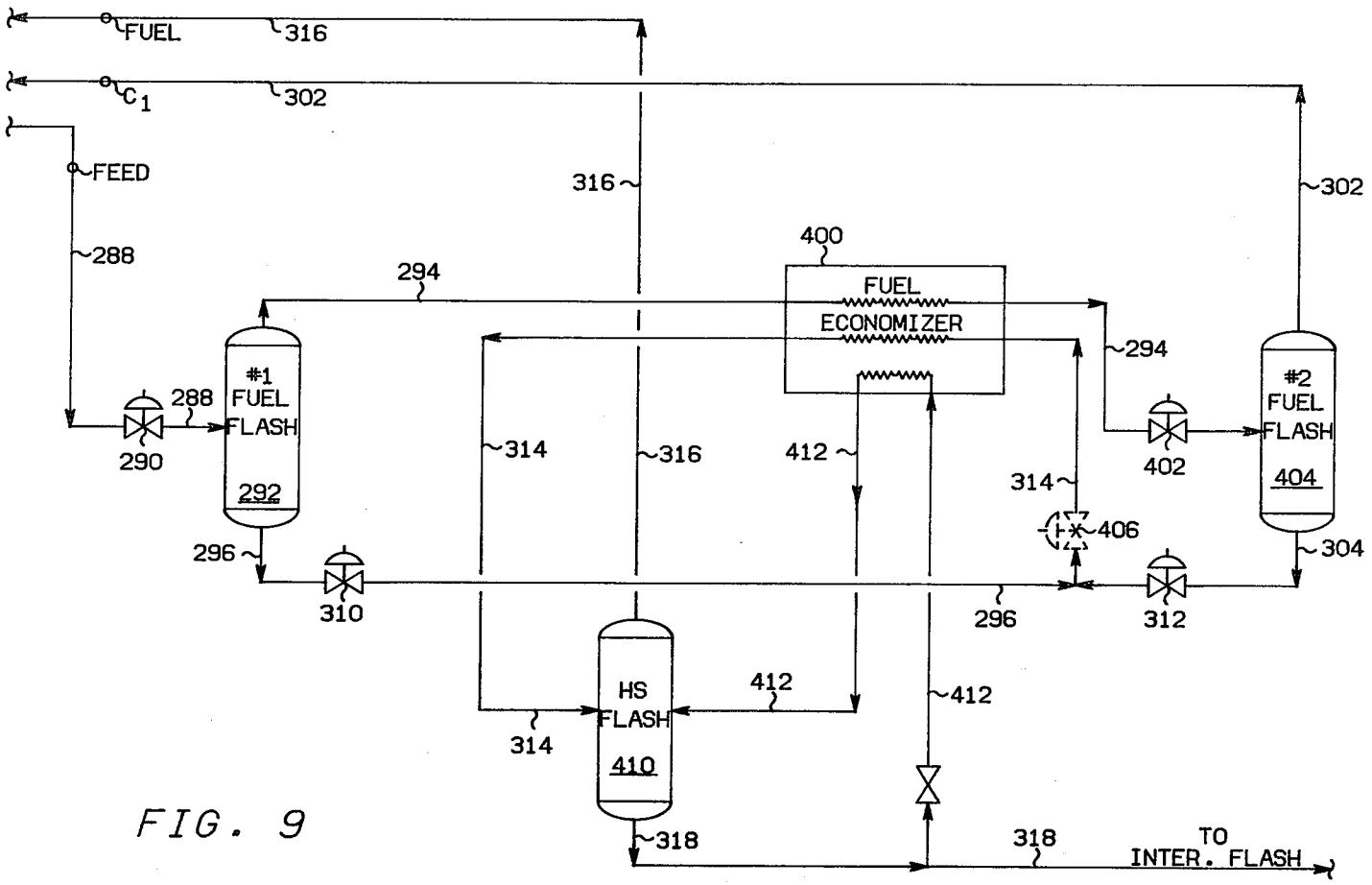
FIG. 9 is an enlarged flow diagram of another embodiment of the nitrogen removal system shown in FIG. 4.

FIG. 9 of the drawings is an enlarged view of yet another embodiment of the nitrogen removal system enclosed within the dashed box of FIG. 4. In FIG. 9, the same numerical designations have been utilized to indicate the same flow lines and items of equipment shown in FIG. 4 of the drawings. In the embodiments shown in FIG. 9, the first vapor phase portion, enriched in nitrogen and withdrawn from fuel flash drum 292, is passed through line 294 and cooled in heat exchanger or fuel economizer 400. The cooled first vapor phase portion is then expanded through an expansion valve 402 and fed to a second fuel flash drum 404. The second fuel flash drum 404 separates the cooled and expanded first vapor phase portion into the second vapor phase portion, further enriched in nitrogen, which is withdrawn through line 302 and ultimately used as a fuel, from the second liquid phase portion comprising liquefied natural gas which is withdrawn through line 304. The first and second liquid phase portions passing through lines 296 and 304 and expanded through expansion valves 310 and 312, respectively, are combined and passed through line 314. Rather than utilize individual expansion valves 310 and 312, a single expansion valve 406 could be utilized in line 314. However, the two expansion valves are preferred since the pressures of the streams passing through lines 296 and 304 will normally differ and the two expansion valve arrangement provides better control and equalization of the pressures of the two streams. The expanded, combined liquid phase stream passing through line 314 is, of course, cooled by expansion and is utilized to provide at least a part of the cooling of the first vapor phase portion, enriched in nitrogen, by passing the combined liquid phase streams in indirect heat exchange with the first vapor phase portion in heat exchanger or fuel economizer 400. After passage through fuel economizer 400, the expanded, combined first and second liquid phase portions are then passed to high stage flash drum 410. The expanded fluids are separated into the third vapor phase portion comprising the high stage methane stream, which is eventually recycled and which is withdrawn from flash drum 410 through line 316, and the liquefied natural gas main stream, which is withdrawn from high stage flash drum 410 through line 318. If desired, additional cooling of the first vapor phase portion enriched in nitrogen and cooled in heat exchanger or fuel economizer 400 can be provided by withdrawing a portion of the liquefied natural gas passing through line 318, passing the same through line 412, through heat exchanger 400 and thence back to high stage flash drum 410.

Figure 10:
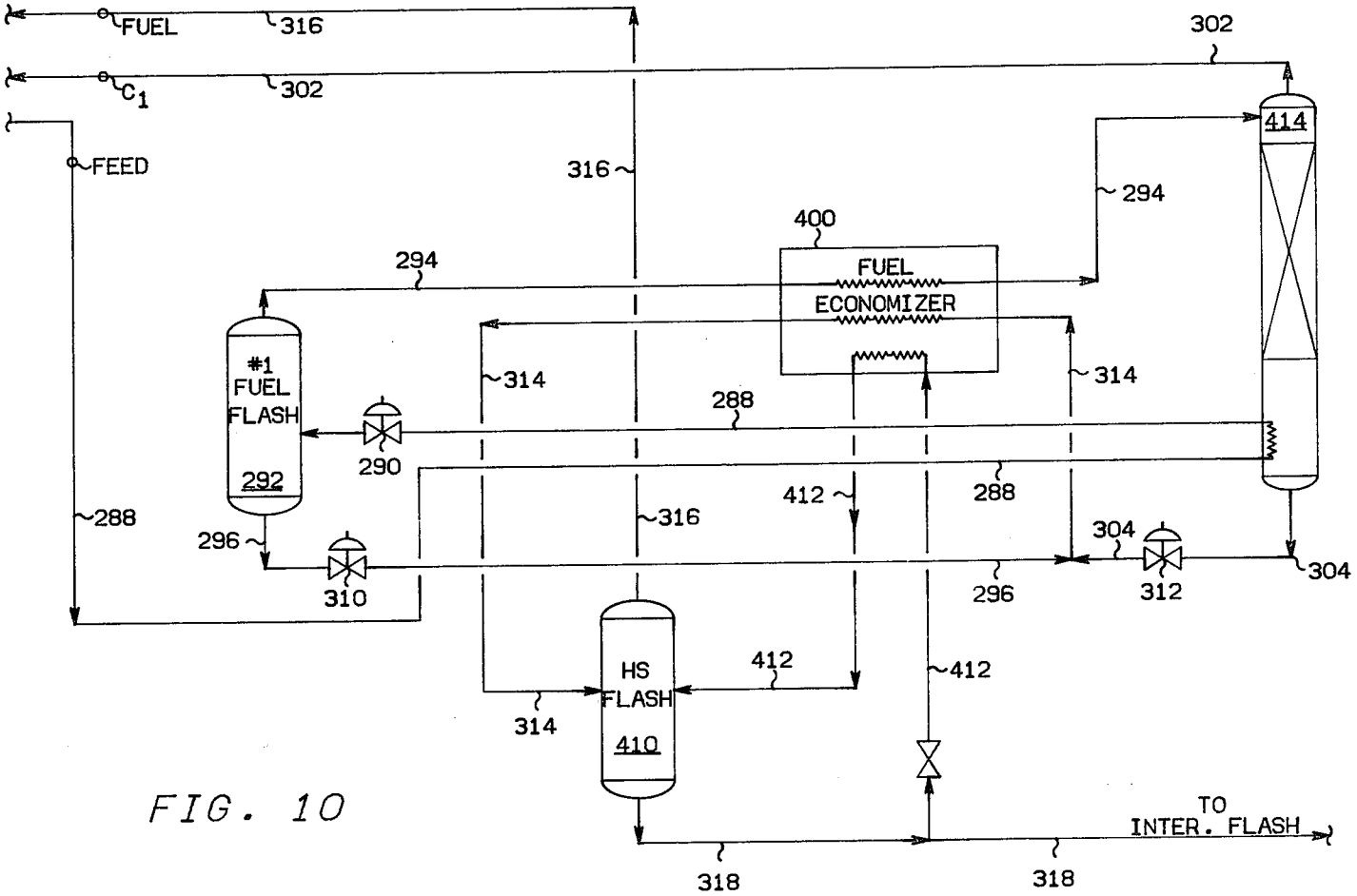
FIG. 10 is a flow diagram of a modified nitrogen removal system similar to that of FIG. 9.

FIG. 10 of the drawings shows a modification of the nitrogen removal system of FIG. 9. FIG. 10 differs from FIG. 9 in that a nitrogen removal fractionation column is substituted for the No. 2 fuel flash drum 404 of FIG. 9. In accordance with FIG. 10 the first vapor phase portion, enriched in nitrogen, passing through line 294 and cooled in heat exchanger 400, is fed to the nitrogen removal fractionation column 414, where it is separated into the second vapor phase portion, further enriched in nitrogen, and passed through line 302, and the unvaporized second liquid portion comprising the liquefied gas passed through line 304. The liquefied feed gas entering the nitrogen removal system through line 288 may also be passed through a reboiler mounted in the bottom of nitrogen removal column 414 in order to provide heat to the fluids in the column.

The following table illustrates a typical operation of the nitrogen removal system of FIG. 5. Typical temperatures and pressures at significant points in the system are listed with reference to the flow line or item of equipment number of FIG. 5 where the condition exists.

TABLE V

| Flow Line or Equipment Item | Temp., °F. | Pressure, psia |
|---|---|---|
| 288 | −142 | 555 |
| 294 | −163 | 350 |
| 300 | −182 | 347 |
| 302 | −218 | 130 |
| 304 | −156 | 347 |
| 296 | −163 | 350 |
| 314 | −187 | 182 |
| 316 | −187 | 182 |
| 318 | −190 | 182 |

Figure 11:
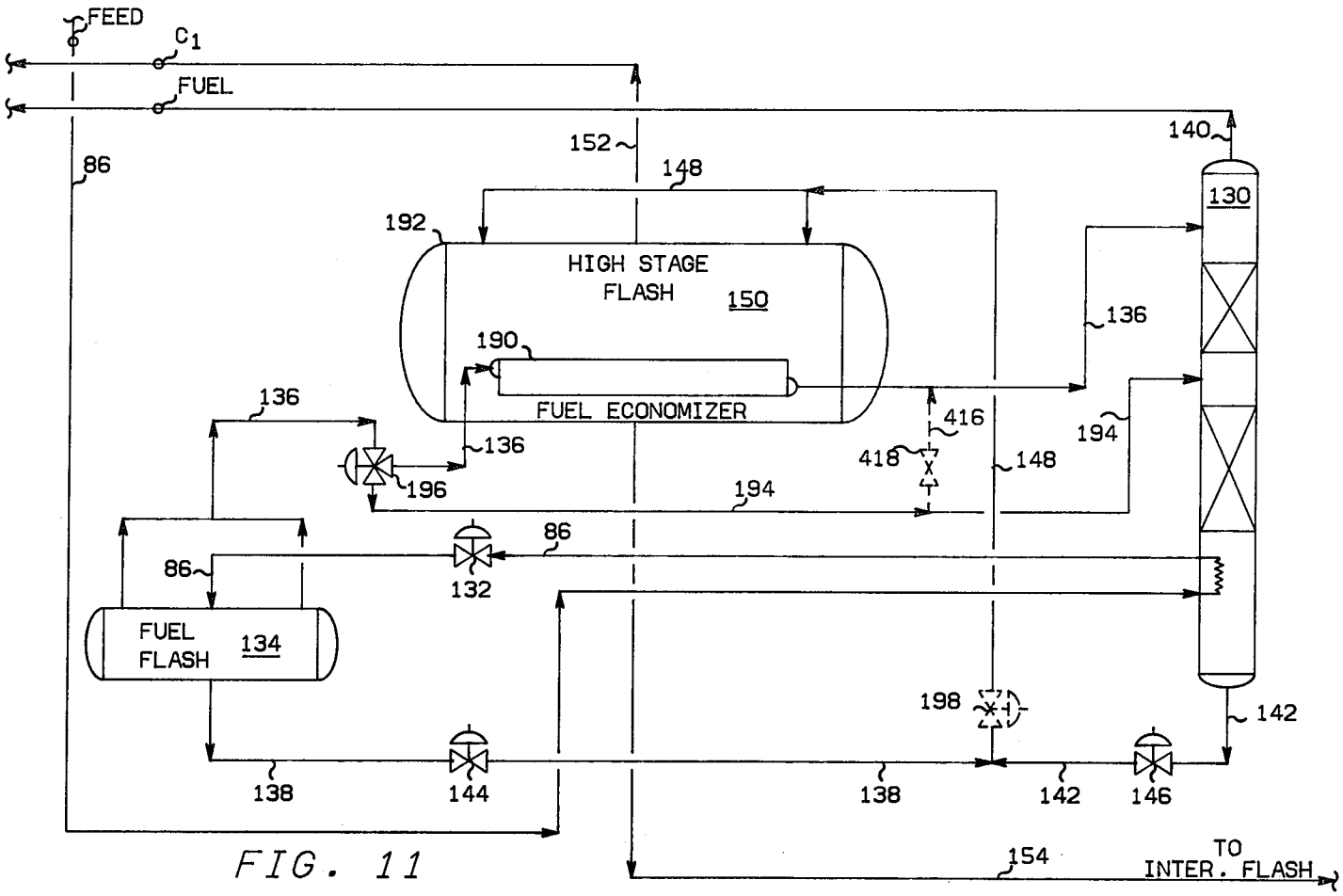
FIG. 11 is a flow diagram of a modification of the nitrogen removal system of FIG. 2.

FIG. 11 of the drawings shows an alternative to the system of FIG. 2. In accordance with FIG. 11, the first vapor phase portion, enriched in nitrogen, bypassing high state flash fuel-economizer 150 through line 194 can be fed to column 130 at a lower point than the first vapor phase portion, enriched in nitrogen, which has passed through fuel economizer 150 and is fed to the top of tower 130. In this particular instance, rather than having a solid packed tower, as in FIG. 2, two packings would be employed and the stream passing through 194 would be introduced between the two packings. Simply by adding an alternative line 416 and a valve therein 418, the system of FIG. 11 can be operated as in FIG. 2, except that the amount of bypassed first vapor phase passing through line 194 and recombined with the first vapor phase portion passing through line 136 can be controlled so as to adjust the volume of the first vapor phase portion passed to the top of the tower and to the center portion of the tower.

In this particular instance, the following Table VI illustrates typical temperatures in the flow lines, as indicated.

TABLE VI

| Flow Line | Temp. °F. |
|---|---|
| 136 (to top of column) | −184 |
| 136 (to center of column) | −156 |
| 152 | −189 |
| 140 | −170 |

Figure 12:
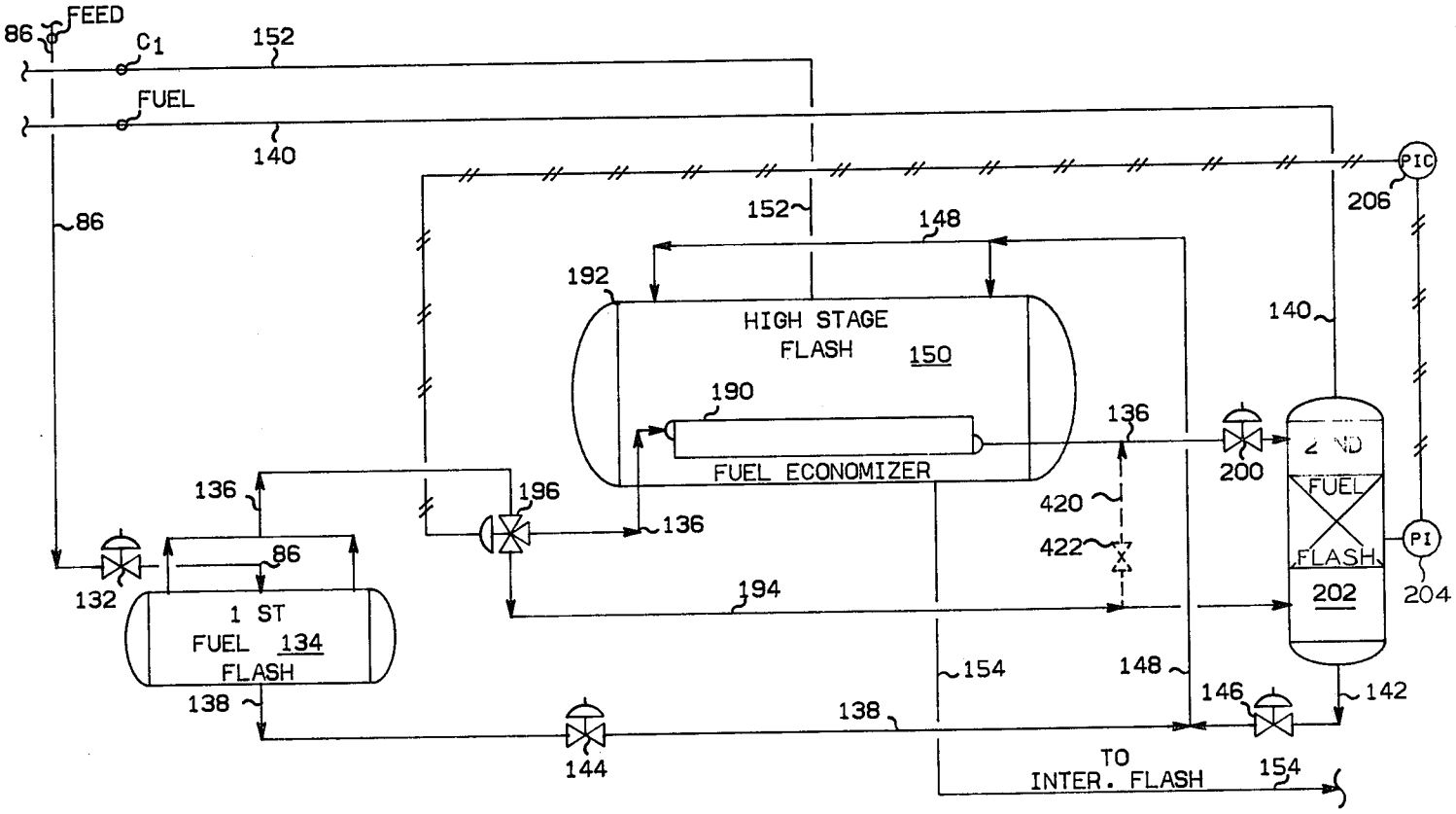
FIG. 12 is a flow diagram of a modification of the nitrogen removal system of FIG. 3.

FIG. 12 of the drawings shows a similar alternative to the system of FIG. 3. Specifically, the first vapor phase portion bypassing high stage flash fuel-economizer 150 would be fed to the bottom of the second fuel flash drum 202 or alternatively (as in FIG. 3) through line 420 controlled by valve 422. Passage through line 420 can be in addition to passage to the bottom of the tower. In this case, the tower would preferably include a packing between the two feed streams thereto.

In this case, typical temperatures would be line 136°-184° F., line 194°-156° F., line 140°-165° F. and line 142°-160° F.

Figure 13:
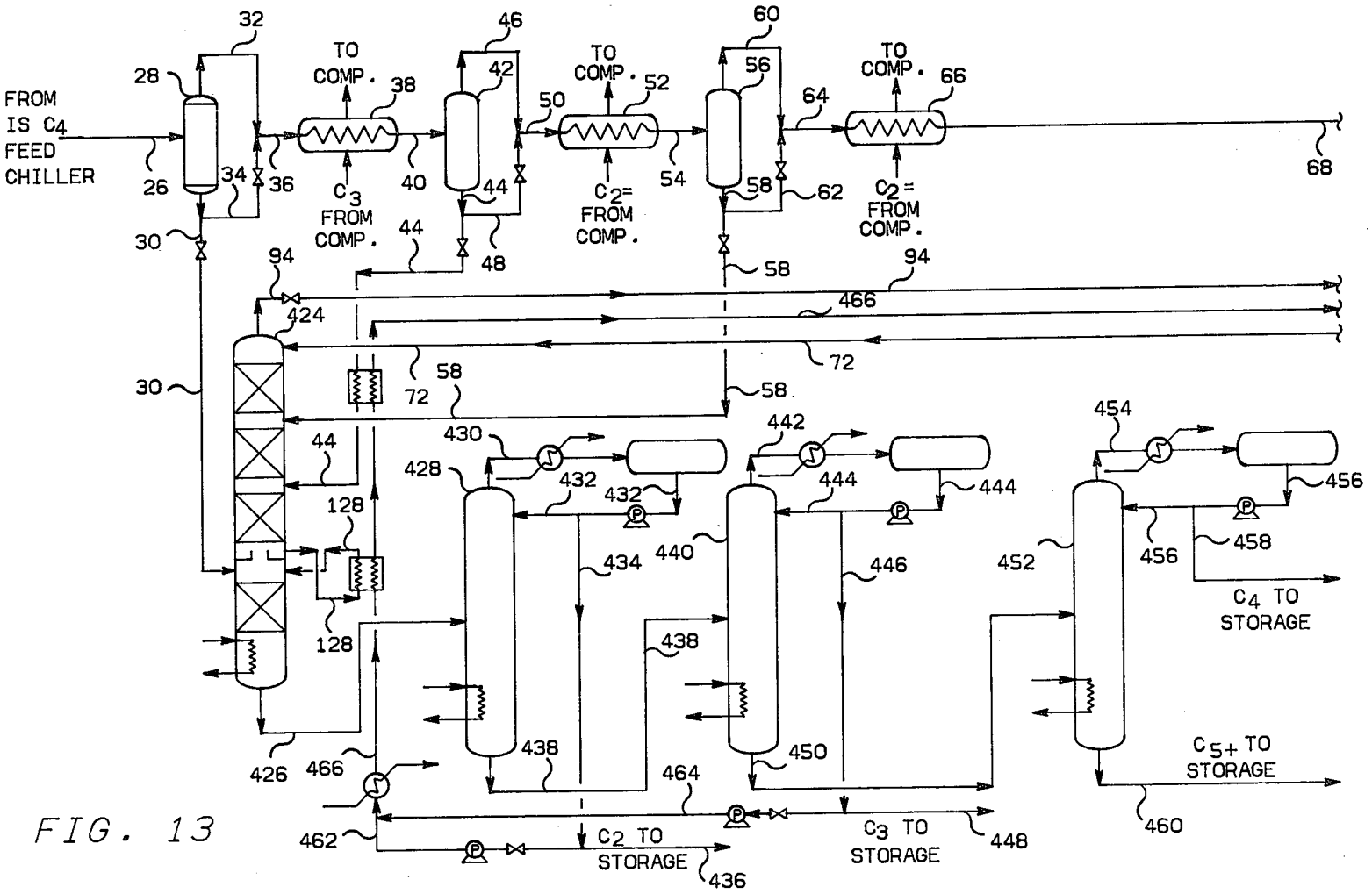
FIG. 13 is a flow diagram of a modification of the natural gas liquefaction system of FIG. 1 and is the preferred system of the present invention.

FIG. 13 of the drawings is a partial schematic of a natural gas liquifaction and separation system, such as that shown in FIG. 1 of the drawings, and includes a preferred system for separation of $C_2$ and higher molecular weight hydrocarbons from a natural gas stream. In FIG. 13, to the extent that items of equipment and flow lines are the same as those shown in FIG. 1, the same identifying numbers have been used.

The main gas stream, after cooling in feed chiller 24 (FIG. 1) and passing through line 26, proceeds through the remainder of the cooling cycles in the same manner as previously described in connection with the description of FIG. 1. However, the liquid portions separated from the main gas stream during the cooling cycles and passing through lines 30, 44, 58 and 72 (FIGS. 1 and 13, as appropriate) are fed to column 424. Column 424 is similar to column 88 of FIG. 1 and the liquid portions fed to the column are introduced in essentially the same manner and at essentially the same points as they were in the system of FIG. 1; but in this instance, column 424 is operated as a demethanizer rather than a deethanizer, as in FIG. 1. Accordingly, vapors separated in column 424 comprise principally methane and whatever small amounts of nitrogen were present in the original feed. This vapor is then discharged from column 424 and passed through line 94 where it is recycled to the main gas stream, as previously described in connection with FIG. 1. The liquid portion separated in column 424 comprises principally $C_2$, $C_3$, $C_4$, $C_5$ and higher molecular weight hydrocarbons and is withdrawn through line 426. The liquid fraction withdrawn through 426 is then fed to a bottom heated column 428, where a portion thereof is vaporized. This column is similar to columns 98 and 108 of FIG. 1. Column 428 is operated as a deethanizing column and therefore, the vapor separated in column 428 comprises principally $C_2$ and is discharged through line 430. The vapor passing through line 430 is condensed and at least a portion thereof may be passed through line 432 as a reflux to column 428. The main stream, however, is passed through line 434. At least a part of the $C_2$ fraction is then passed through line 436 to storage or is recycled, as hereinafter described. The liquid phase separated in column 428 is discharged through line 438 and fed to bottom heated column 440. Bottom heated column 440 is operated as a depropanizer and, consequently, the vapor stream discharged through line 442 comprises principally $C_3$ hydrocarbons. This vapor phase, passing through line 442, is condensed and at least a portion may be recycled to column 440 through line 444. The main stream, however, is passed through line 446. At least a portion of the $C_3$ stream passing through line 446 may be withdrawn and sent to storage through line 448 or, as hereinafter described, recycled. The liquid separated in column 440 is withdrawn through line 450 and fed to column 452 operated as a debutanizer. Consequently, the vapor from column 452 comprises principally $C_4$, which is discharged through line 454. This vapor phase is then condensed and at least a portion thereof may be recycled to column 452 through line 456. The main stream, however, is withdrawn through line 458. In this particular embodiment, the $C_4$ fraction is sent to storage for other uses. However, it may be recycled, as hereinbefore described in connection with FIG. 1. The liquid separated in column 452 comprises principally the normally liquid components of the natural gas stream ($C_5$ and higher molecular weight hydrocarbons originally present in the main gas stream) and these natural gas liquids are withdrawn through line 460 and sent to storage for other use. Rather than withdrawing the $C_2$ and $C_3$ fractions from the system, at least a portion of the $C_2$ and or $C_3$ streams may be recycled as liquids through lines 462 and 464, respectively. As previously suggested, this recycle may also include at least a portion of the $C_4$ fraction passing through line 458. In any event, the $C_2$, $C_3$ and, optionally $C_4$ fractions, in liquid form, are combined in line 466 and recycled to the main gas stream, as previously described in connection with FIG. 1.

While specific compositions and conditions of operation have been set forth herein and specific items of equipment and processing steps have been described, it is to be understood that such recitations are by way of illustration and example only and are not to be considered limiting.

I claim:

1. A process for liquifying and reducing the nitrogen content of a normally gaseous natural gas feed comprising predominantly methane with significant amounts of nitrogen and in its vapor phase at an elevated pressure, comprising:

(a) cooling said natural gas feed, in a first cooling step comprising at least one cooling stage, to liquify the same;

(b) separating the thus liquified natural gas feed, in a first separation step, into a first vapor phase, containing a major portion of said nitrogen, and an unvaporized first liquid phase, comprising liquified natural gas;

(c) further cooling at least a part of the thus separated first vapor phase, in a second cooling step;

(d) separating the thus cooled first vapor phase, in a second separation step, into a second vapor phase, further enriched in nitrogen, and an unvaporized second liquid phase, comprising liquified natural gas;

(e) recovering the thus separated second vapor phase as a product of the process;

(f) expanding the thus separated first liquid phase and the thus separated second liquid phase, in at least one expansion step, to produce a single vapor-liquid mixture therefrom;

(g) passing the thus separated first vapor phase in indirect heat exchange with the thus produced vapor-liquid mixture, in said second cooling step, prior to said second separation step, to provide at least part of the cooling of said first vapor phase in said second cooling step;

(h) separating said vapor-liquid mixture, in a third separation step, into a third vapor phase, comprising methane containing additional nitrogen, and a third liquid phase, comprising liquified natural gas; and (i) recovering the thus separated third liquid phase as the liquified natural gas product of the process.

2. A process in accordance with claim 1 wherein the second separation step is a fractionation step.

3. A process in accordance with claim 2 wherein a first part of the first vapor phase is thus cooled in the second cooling step and is passed to an upper portion of the fractionation step and the remaining, uncooled part of the first vapor phase is introduced into a lower portion of said fractionation step.

4. A process in accordance with claim 1 wherein the second separation step comprises expanding at least part of the first vapor phase and passing the thus expanded at least part of the first vapor phase and any remaining unexpanded part of the first vapor phase to a flash separation step.

5. A process in accordance with claim 4 wherein a first part of the first vapor phase is cooled in the second cooling step, the thus cooled first part of the first vapor phase is thus expanded, the thus expanded first part of the first vapor phase is thus passed to the flash separation step and the remaining, uncooled and unexpanded part of said first vapor phase is thus passed to the flash separation step.

6. A process in accordance with claim 5 wherein rising vapors and falling liquid in the flash separation step pass through a permeable contact material disposed in the flash separation step between the point of introduction of the thus cooled and thus expanded first part of the first vapor phase and the point of introduction of the remaining, uncooled and unexpanded part of the first vapor phase.

7. A process in accordance with claim 4 wherein the thus cooled and thus expanded first part of the first vapor phase is passed to an upper portion of the flash separation step and the remaining, uncooled and unexpanded part of the first vapor phase is passed to a lower portion of the flash separation step.

8. A process in accordance with claim 1 wherein the third separation step is a flash separation step and at least a part of the first vapor phase is thus cooled, in the second cooling step, by passing the same in indirect heat exchange with the body of fluids in said flash separation step.

9. A process in accordance with claim 1 wherein the third separation step comprises passing the vapor-liquid mixture to a flash separation step after said vapor-liquid mixture has been thus passed in indirect heat exchange with the first vapor phase in the second cooling step.

10. A process in accordance with claim 9 wherein a part of the thus separated third liquid phase is recycled to the flash separation step of the third separation step before thus recovering said third liquid phase as the liquified natural gas product of the process.

11. A process in accordance with claim 1 wherein the third vapor phase is compressed and recycled back to the natural gas feed.

12. A process in accordance with claim 11 wherein the third vapor phase is passed in indirect heat exchange with the thus compressed third vapor phase prior to thus recycling said compressed third vapor phase back to the natural gas feed.

13. A process in accordance with claim 1 wherein the second vapor phase is expanded and the thus expanded second vapor phase is passed in indirect heat exchange with the thus separated first vapor phase, in the second cooling step, to provide a second part of the cooling of said first vapor phase in said second cooling step.

14. A process in accordance with claim 13 wherein the third separation step is a flash separation step and the thus separated first vapor phase is cooled, in the second cooling step, by passing said first vapor phase and the thus expanded second vapor phase in indirect heat exchange with one another and with the body of fluid in said flash separation step.

15. A process in accordance with claim 13 wherein the thus separated first vapor phase is cooled, in the second cooling step, by passing said first vapor phase, the expanded second vapor phase and the vapor-liquid mixture in indirect heat exchange with one another in a single heat exchange step and the third separation step comprises passing the vapor-liquid mixture to a flash separation step after said vapor-liquid mixture has been thus passed in indirect heat exchange with said first vapor phase and said expanded second vapor phase in said second cooling step.

16. A process in accordance with claim 13 wherein the second vapor phase is thus expanded by passing the same through an expansion valve.

17. A process in accordance with claim 13 wherein the second vapor phase is thus expanded by passing the same through an expansion portion of a turbo expander-compressor.

* * * * *